US007621404B2

(12) United States Patent
Murray

(10) Patent No.: US 7,621,404 B2
(45) Date of Patent: Nov. 24, 2009

(54) INSULATING PACKAGING MATERIAL AND RELATED PACKAGING SYSTEM

(75) Inventor: Joeseph C. Murray, Mobile, AL (US)

(73) Assignee: Thermafreeze Products Corporation, Theodore, AL (US)

( * ) Notice: Subject to any disclaimer, the term of this patent is extended or adjusted under 35 U.S.C. 154(b) by 679 days.

(21) Appl. No.: 09/919,747

(22) Filed: Aug. 1, 2001

(65) Prior Publication Data

US 2003/0087051 A1 May 8, 2003

Related U.S. Application Data

(63) Continuation-in-part of application No. 09/366,446, filed on Aug. 3, 1999, now Pat. No. 6,536,189.

(51) Int. Cl.
*B65D 81/02* (2006.01)

(52) U.S. Cl. ..... 206/594; 220/592.2; 383/110

(58) Field of Classification Search ..... 206/521, 206/522, 591–594, 484; 220/592.2, 592.26; 229/87.02, 91; 383/109, 110; 428/34.2, 428/35.2, 178, 194; 62/457.1
See application file for complete search history.

(56) References Cited

U.S. PATENT DOCUMENTS

| | | | |
|---|---|---|---|
| 2,149,412 | A | 3/1939 | Bangs |
| 2,302,639 | A | 11/1942 | Moore |
| 2,467,268 | A | 4/1949 | Merkle |
| 2,496,731 | A | 2/1950 | Longo |
| 3,890,762 | A | 6/1975 | Ernst et al. |
| 4,000,815 | A | 1/1977 | Wingbro et al. |
| 4,294,079 | A | 10/1981 | Benson |
| 4,862,674 | A | 9/1989 | Lejondahl |
| 4,882,893 | A | 11/1989 | Spencer et al. |
| 4,908,248 | A | 3/1990 | Nakashima et al. |

(Continued)

FOREIGN PATENT DOCUMENTS

| | | |
|---|---|---|
| CA | 942263 | 2/1994 |

(Continued)

OTHER PUBLICATIONS

Printout of Vitsab Home Page (May 17, 2001).

(Continued)

*Primary Examiner*—Luan K Bui
(74) *Attorney, Agent, or Firm*—Barry E. Negrin; Pryor Cashman LLP

(57) ABSTRACT

Insulating packaging material is positioned around a product, including 1-ply, 2-ply, or 3-ply material. Some of the embodiments include a layer of bubble wrap material having its bubble side placed against the flat side of the adjacent ply, which can be metalized plastic film, a foam layer, or both. With such an arrangement, air pockets are formed between the bubbles and the other ply's flat surface. A separate layer of bubble wrap may be similarly placed about the interior of the box A system for delivering perishable groceries includes a box; a source of cold (or heat) maintaining the temperature inside the box within a desired temperature range, and using a pouch of packet material. Each packet may contain a super-absorbent polymer which is hydrated and then either frozen or heated, without producing moisture when thawing or cooling.

6 Claims, 15 Drawing Sheets

U.S. PATENT DOCUMENTS

| | | | | | |
|---|---|---|---|---|---|
| 4,931,333 | A | | 6/1990 | Henry | |
| 5,031,418 | A | | 7/1991 | Hirayama et al. | |
| RE34,533 | E | | 2/1994 | Wigley | |
| 5,450,948 | A | | 9/1995 | Beausoleil et al. | |
| 5,619,841 | A | | 4/1997 | Muise et al. | |
| 5,628,845 | A | | 5/1997 | Murray et al. | |
| 5,639,523 | A | * | 6/1997 | Ellis | 206/521 |
| 5,697,961 | A | | 12/1997 | Kiamil | |
| 5,785,980 | A | | 7/1998 | Mathewson | |
| 5,820,268 | A | * | 10/1998 | Becker et al. | 383/110 |
| 5,945,147 | A | | 8/1999 | Borchard | |
| 5,966,962 | A | | 10/1999 | Murray et al. | |
| 6,139,188 | A | * | 10/2000 | Marzano | 206/522 |
| 6,296,134 | B1 | * | 10/2001 | Cardinale | 220/495.05 |
| 6,410,119 | B1 | * | 6/2002 | De Luca et al. | 206/522 |
| 6,443,309 | B1 | * | 9/2002 | Becker | 206/594 |

FOREIGN PATENT DOCUMENTS

| | | |
|---|---|---|
| WO | WO 94/15841 | 7/1994 |

OTHER PUBLICATIONS

Printout of Cox Technologies Home Page (Oct. 10, 1999), (7 pages).

* cited by examiner

Kosher Meat Purveyor - 72 Hour LAB Test - 5 Feb to 8 Feb - Summary Graph (All Rights Reserved)

[Prepared Meal Producer] 21 Dec to 24 Dec (All Rights Reserved)

72 Hour LAB Shipping Test for Dysphagia Diet Foods Shipment [Summary Graph]

International Processed Potato Producer - 88:05 Hour (3 Days, 16 Hrs, 5 Mins) FIELD Test
Time of Test - 5 Apr to 9 Apr via UPS Ground Service - Summary Graph *(All Rights Reserved)*

[Midwestern Candy Manufacturer] - 66-Hour FIELD Test - 23 to 26 April, 2001

SUMMARY Test Results From Test in Plain Corrugated Box *(All Rights Reserved)*

NON-ATTENDED Scenario - 15-Hr, 30 Min Emulated Perishables Delivery (in Corrugated Box) with last 3 Hours, 20 Minutes in Direct Sunligh Emulating Ouside Home Standing Time (All Rights Reserved)

24-Hour Lab Chamber Torture Test - 19 to 20 April

Summary of Results from ThermaBarrier 12 x 16 x 1/2"MF Pouch Test (All Rights Reserved)

INSULATING PACKAGING MATERIAL AND RELATED PACKAGING SYSTEM

REFERENCE TO RELATED APPLICATION & PATENTS

This application is a continuation-in-part of Ser. No. 09/366,446 filed Aug. 3, 1999 entitled "Computerized, Monitored, Temperature Affected, Delivery System for Perishable Goods," issued as U.S. Pat. No. 6,536,189 on Mar. 25, 2003. Reference also is hereby made to the patent application entitled "Hydration and Freezing Plant for Flexible Refrigerant Media" filed Jul. 11, 1997 as Ser. No. 08/893,405, one of the two co-inventors, namely, Messrs. Murray and Gaude, being the inventor hereof, namely, Mr. Murray, now abandoned in favor of the patent application entitled "Modular Hydration and Freezing Plant for Flexible Refrigerant Media" filed May 8, 1998 as Ser. No. 09/075,429, also filed by Messrs. Murray and Gaude, being issued as U.S. Pat. No. 5,966,962 on Oct. 19, 1999, and application entitled "Porous, Laminated, Super Absorbent, Hydratable, Temperature Control Pack System" filed May 15, 1998 as Ser. No. 09/079,872 by Messrs. Murray & Gaude and Ms. Gabel, being issued as U.S. Pat. No. 6,269,654 on Aug. 7, 2001, the disclosures of all of which applications and patents also are incorporated herein by reference. Reference is likewise had to U.S. Pat. No. 5,628,845 issued May 13, 1997 entitled "Process for Forming Hydratable, Flexible Refrigement Media" by Murray and Browne, the former being the inventor hereof, the disclosure of which patent likewise is incorporated herein by reference.

TECHNICAL FIELD

The present invention relates in part to devices, including packaging and coverings used to produce or maintain desired temperature levels substantially different from the ambient for an extended period of time, and more particularly to an insulating, packing material and a related packaging system using such material, typically along with other packaging elements or components, which can be used, for example, among many other applications, in a computerized follow-up and tracking system using such devices, as well as others, including particularly temperature and time extent monitoring, in the delivering and temperature protection of perishable goods, such as, for example, temperature sensitive groceries, seafood, pharmaceuticals preparations, medicines, confections, temperature sensitive gifts, plants, flowers or floral arrangements, and the like. The exemplary product and packaging system of the present invention, as well as their exemplary use in an exemplary application methodology, are described below in detail as they apply in the food or grocery delivery industry. However, the present invention also has application in such additional industries as the temperature protective delivery of seafood, pharmaceuticals, medical shipments (e.g., test specimens in the clinical laboratory segment), confectionery, gift packages, flowers or floral arrangements, etc., as well as insulation packaging applications generally, not necessarily just for perishable goods.

BACKGROUND ART

As a general proposition, it is known in the transportation industry to attempt to achieve some degree of desired temperature control for products being shipped using, for example, gel packs, "dry ice" (frozen carbon dioxide) and the like. As a substantial advance over the foregoing prior art devices, vastly improved, cooling or heating devices using sheets of packet material which include porous cells containing a super-absorbent polymer have much more recently been suggested, which are described in some detail in the above referenced patent and patent applications. Further reference is had to U.S. Pat. No. 5,628,845 issued May 13, 1997 entitled "Process for Forming Hydratable, Flexible Refrigement Media" by Murray and Browne, and to PCT/US 92/06486 (published as WO 93/02861 on Feb. 18, 1993) of George Barrett (now deceased), a predecessor to the work that preceded the present invention.

For general background, informational, purposes, reference is also had to the article entitled "Pharmaceutical shipments chill out from within" from the January 1998 edition of *Packaging World* (a Summit publication, One IBM Plaza, Suite 3131, 330 N. Wabash Ave., Chicago, Ill. 60611; note p. 38), which article discusses some of the beneficial effects of early test work which preceded the present invention.

For example, as disclosed in one or more of these patents and/or publications, the sheets of packet material are initially submerged in water, hydrating them, and the hydrated sheets are then frozen (for cooling effects) or heated (for heating effects) and placed in at least some proximity to and more typically in juxtaposition to the goods to be cooled/heated. As the packet sheet(s) begin, for example, to warm up or thaw, the absorbed "water" goes directly from the frozen state into a gaseous state, avoiding wetness problems. The cells are formed in packets, producing longitudinally and laterally extended separation lines, which allow the completed packet sheets to be folded about either or both axes and thus contoured around the goods being cooled (or heated), surrounding them.

With respect to temperature and elapsed time monitoring in connection with the product "VitSab," see the information provided by Cox Technologies on the product in the attached printed references, as well as more detailed information contained in the parent application.

In a separate art, it is desired to have, for example, groceries or other perishable products delivered from a purveyor to a consumer, a practice which was somewhat commonplace in the first half of the $20^{th}$ Century but generally since then has become relatively rare in comparison to the direct purchase of groceries at the supermarket. However, with the blossoming of the Internet and e-commerce on the Internet and orders faxed to the purveyor, great interest is again being directed to the delivery and shipment of groceries, as well as other perishable or temperature sensitive goods, in connection with an order placed over the Internet, as well as by telephone.

The packaging and delivery of orders for such goods provides an exemplary application, among many, many others, for the insulating, packaging material and its related packaging system of the present invention but many of the details of which are not part of the present invention. Additional information on the background of this particular application is contained in the specification of the parent application.

With respect to some, additional background information on insulating packaging materials and related packaging systems, reference is had, not only to the applications, patents and references above but also to:

| Patent/Pub. No. | Inventor(s) | Issue/Pub. Date |
|---|---|---|
| 2,149,412 | Bangs | Mar. 7, 1939 |
| 2,302,639 | Moore | Nov. 17, 1942 |
| 2,467,268 | Merkle | Apr. 12, 1949 |
| 2,496,731 | Longo | Feb. 7, 1950 |

-continued

| Patent/Pub. No. | Inventor(s) | Issue/Pub. Date |
|---|---|---|
| 3,890,762 | Ernst et al | Jun. 24, 1975 |
| 4,000,815 | Wingbro et al | Jan. 4, 1977 |
| 4,294,079 | Benson | Oct. 13, 1981 |
| 4,862,674 | Lejondahl | Sep. 5, 1989 |
| 4,882,893 | Spencer et al | Nov. 28, 1989 |
| 4,908,248 | Nakashima et al | Mar. 13, 1990 |
| 4,931,333 | Henry | Jun. 5, 1990 |
| 5,031,418 | Hirayama et al | Jul. 16, 1991 |
| Re. 34,533 | Wigley | Feb. 8, 1994 |
| 5,450,948 | Beausoleil et al | Sep. 19, 1995 |
| 5,619,841 | Muise et al | Apr. 15, 1997 |
| 5,697,961 | Kiamil | Dec. 16, 1997 |
| 5,785,980 | Mathewson | Jul. 28, 1998 |
| 5,945,147 | Borchard | Aug. 31, 1999 |
| Canadian 942,263 | Clader | Feb. 19, 1994 |
| WO 94/15841 | Corneliussen | Jul. 21, 1994 |

The present invention provides a utilitarian, innovative solution to the problem of needing and having highly improved insulating materials and packaging solutions for temperature sensitive and/or perishable goods of practically all types.

GENERAL DISCUSSION OF INVENTION

As noted above, the present invention relates in part to packaging systems, including packaging and coverings used to produce or maintain desired temperature levels substantially different from the ambient for an extended period of time, for use, for example, in the delivering and temperature protection of perishable goods, such as, for example, groceries, seafood, medicines, confections, temperature sensitive gifts, plants, flowers or floral arrangements, and the like. The exemplary product and methods solutions of the present invention are described below in detail as they apply in the food or grocery delivery industry to protect the delivery of perishable food items. However, the present invention also has application in such additional industries as the delivery of seafood, pharmaceuticals, medical shipments (e.g., test specimens in the clinical laboratory segment), confectionery, gift packages, flowers or floral arrangements, etc., as well as many others The preferred insulating, packaging material of the present invention is directed to, in some embodiments, a bubble-wrap type of material used in a unique way and relationship in connection with the packaging of goods which need to have their temperature maintained, whether in a refrigerated or frozen state or whether they are in a temperature elevated state, with the former being more typical. Additionally, the present invention is directed to the use of the preferred insulating, packaging material in combination with other packaging elements in a unique packaging system for the packing of such goods, as well as other goods.

1. One of the properties of the bubble wrap approach is that the bubbles contain entrapped air. Trapped air forms a thermal barrier to heat energy from conduction or convection. In theory and proven practice, the trapped air inside the bubbles will slow down thermal transfer across the wall of a pouch, liner or other configuration, from the outside heat source to the inside of the pouch, liner, etc.

2. When a producer laminates bubble wrap to foam or another substrate for thermal protection purposes using prior art approaches, it is easiest to manufacture the lamination with the flat side of the bubble wrap against the substrate. The downside of the finished product made in that manner is that there is a thermal penetration gap around each "bubble" where the lower edges of the bubble join the flat side of the bubble wrap structure. In such a configuration, heat from conduction finds an easy entry into the payload area of the pouch, liner, etc., by conveying heat energy from the surrounding area to the penetration gaps between the bubbles. The heat energy will transfer more slowly through the trapped air inside the bubbles but will move quickly through the penetration gaps to the interior of the pouch, liner, etc.

3. The art of the present invention produces pouches, liners, etc., in the 2-ply or 3-ply versions described more fully below with the bubble side of the bubble wrap facing the flat, sometimes metallized surface of the substrate structure. That technique produces many advantages:

The "penetration gap" negative is turned into a positive since air is now trapped between the bubbles in addition to being trapped inside the bubbles. The flat surface of the bubble wrap becomes the outer ply of the structure of the pouch, liner, etc. Thus, every "penetration gap" becomes an additional "bubble" of trapped air, providing an enhanced stop or shield against thermal energy from conduction. This structure prolongs the time required for thermal energy to penetrate the interior of the pouch, liner, etc., keeping the product being transported in the desired temperature range for a longer time. This property lowers freight rates for customers by permitting longer transit times.

In the version using a metal (foil) ply, the flat, metallized surface serves as a protection against radiant (i.e. solar) heat energy. Radiant energy can penetrate the walls of corrugated and boxes or chests made of other materials. If the metallized or other flat surface of the pouch, liner, etc. is in direct contact with a substrate (i.e. a corrugated box wall), it takes on the thermal transfer characteristics of the substrate and its radiant energy shielding property is severely denigrated. However, if the metallized surface can be suspended in air, it works ideally as a radiant energy barrier By producing pouches, liners, etc. with the bubbles of bubble wrap facing a metallized ply, the completed pouch, liner, etc. may be successfully put into, for example, a corrugated box for shipment. Being suspended by the air trapped inside the bubbles and between the bubbles, the radiant barrier layer is, in effect, suspended in air and continues to function as a barrier against radiant energy.

By producing pouches, liners, etc., in the manner described in the invention's preferred, 2-ply and 3-ply embodiments of the pouch and liner products, they provide maximum possible protection against both conducted and radiant energy attack. At least ninety-four (94%) percent of the radiant energy that strikes the suspended metallized surface is, it is believed, "emitted" or "reflected" away from the surface. At the same time, the bubble wrap in the preferred configuration described, dramatically slows heat energy from thermal conduction, since the bubble wrap presents a uniform trapped air barrier to the heat energy attack.

This structure emulates one of the essential points in the practice of "martial arts," specifically, using minimal focussed energy to force an oncoming attacker's energy back on him. This structure uses the minimum amount of natural materials to turn heat energy from radiation, conduction and convection back on itself to keep it out of the pouch, liner, etc,. interior where the temperature sensitive product(s) is/are located for longer times. Other "prior art" structures employ thicker and thicker substrate materials to present a barrier ("R" value) to heat energy. That method requires more bulk and handling for the shipper to achieve the same performance that is achieved with the embodiments of the present invention with less material and bulk.

In use, a temperature sensitive product is packed in such a pouch, liner or other configuration, with an efficient refrigerant product, e.g., ThermaFreeze™ refrigerant described in detail below. The resulting packaging system (or sub-system in a larger packaging strategy) provides an environment inside the pouch, liner, etc. that will keep the product frozen or cold during transit.

The principles of the present invention, the exemplary embodiments of which are provided by the assignee under the mark "ThermaBarrier"™ and can be produced, for example, in several configurations, depending on what the application requires. It can be produced in one, two and/or three ply versions. The exemplary Microfoam®, or other flexible foam used, can have a thickness of as little as about one-eighth (⅛th") inch to about a half (½") inch or thicker. When described as a laminate construction below, it should be understood that the plies may not necessarily be laminated but, instead, may be loose and fitted together rather than laminated into a single construction. The decision on what construction to use typically lies with the application and the customer.

Producers of protective packaging generally recommend thicker (heavier) products (mainly boxes, e.g., "Styorfoam") to attempt to maintain temperatures during shipment. The preferred, ThermaBarrier™ approach of the invention is a light-weight, thin wall product whose properties permit a high thermal shield to ambient heat.

Assignee's "DeliverSafe"™ system, using its ThermaBarrier™ related technology of the present invention, may be used in 1-, 2-, 3- and more ply packaging material, described more fully below, preferably is used to produce pouches, bags, box liners, box covers, pallet covers, shipping container liners, aircraft freight container liners, truck payload bed covers, truck or container temperature zone dividers, and the like. It may also be used for further examples for personal use items for temperature management such as ponchos, vests, tent covers and the like.

Some particularly important aspects of the preferred embodiment of the insulating packaging material of the present invention includes, as follows:

A 1-ply version described more fully below preferably is a metalized plastic film with an emissivity rating of about ninety-four (94) or better. This embodiment preferably is used as a cover for the exemplary, preferred packaging in the packaging system of the present invention. It has the dual qualities of:

being able to "emit" or "reflect" radiant energy (i.e. energy from the sun or other radiant energy source) away from the package containing the perishable goods;

rendering the protective packaging around the perishable goods impervious to rain or other water contamination;

the 2-ply version described more fully below is a metalized plastic film with a layer of bubble wrap laminated to the outside, as described. As a further, exemplary alternative, it may also be a layer of flexible foam (using, for example, Microfoam® as produced by Pactiv, Inc.) with a layer of bubble wrap preferably but not necessarily laminated to the surface of the foam. In the latter case (foam & bubble wrap), radiant protection is lost but protection against conducted heat energy is substantially enhanced. The configuration of the bubble wrap as it faces the metalized film or foam surface is always with the bubbles facing the substrate of the other layer, which makes the bubble wrap the outermost ply of the lamination—preferably in all cases. The dual qualities mentioned just above also apply to this version except if only foam and bubble wrap preferably are used without a metalized layer.

The 3-ply version described more fully below is a laminate construction with a flexible foam (similar to Microfoam® produced by Pactiv, Inc.) as the innermost ply. The Microfoam® may have and preferably does have a metal or foil surface already laminated to one side of the foam or a layer of metalized plastic film may be used instead. The third ply is common bubble wrap that is laminated to the outermost surface of the laminate structure with the bubbles, not the flat side of the bubble wrap, facing the substrate. The dual qualities mentioned above are present in this version with the added advantage that protection against conducted heat energy and radiant energy are both present.

The substantial advantages of this product line approach is that preferably in all versions it is:

LIGHT WEIGHT [an exemplary 3-ply liner for a forty (40#) pound master case of perishable goods weighs only two (2 oz.) ounces];

THIN WALL [when using, for example, a one-eighth (⅛th") inch thick Microfoam® foam, the entire thickness of a 3-ply laminate construction is only five-sixteenth (5/16th") of an inch]; and HIGHTHERMAL SHIELDING [in laboratory and field tests, using, for example, ThermaFreeze™ refrigerant, or any other refrigerant (i.e. dry ice, gel packs, water ice) and a perishable medium. As shown by laboratory and field tests (see test example graphs described below), the efficiency of the total system is determined not only by the efficiency of the refrigerant used, but also by the efficiency of the insulating, packaging material (for example, ThermaBarrier™ products) used will remain constant as to how it repels the heat energy it is exposed to].

All of the preferred packaging system elements of the preferred embodiment of the present invention are numerically listed below (including some which are not directly part of the present invention but rather that of the parent application):

1. An appropriate container for perishable groceries or other perishable products, preferably rigid or at least generally self-supporting in its structure, and preferably a relatively inexpensive, corrugated cardboard box (e.g., with a single flute) or corrugated material, used to contain the perishable products. In its broadest scope, the present invention is not limited to a particular container or a particular cardboard box, although there are certain preferable approaches discussed more fully below.
2. A source of cold (or heat as may be needed), serving as a temperature generator appropriately affecting the temperature inside the container to maintain the temperature inside the box within a desired or acceptable temperature range for a number of hours. Such source preferably is a sheet of packet material containing a super-absorbent polymer which is hydrated and can then be either frozen (e.g., in a freezer) or heated (e.g. in a microwave), as needed, which hydrated packet material affects the temperature of the environment in which it is used for an appropriately long period of time (at least several hours and preferably longer) without producing moisture as it, in the case of a cooling or source, warms up or thaws, or, in the case of a heat or heating source, as it cools down, because the contained "water" goes directly from the solid phase to the gaseous phase, i.e., sublimes into a vaporous form.

3. For cold applications, a protective heat insulating cover, preferably for the entire box (or other container), to protect the box and its contents from external heat from radiation (e.g., sunlight). The balance of the packaging structure inside the heat insulating cover [e.g., the corrugated walls of the box, the hydrated packet material, and the bubble wrap (see below)] present barriers to heat attack from convection (e.g., hot air movement) and/or conduction (e.g., heat transferred from other objects or heated air in contact with the package structure). The protective cover preferably comprises or includes a metallized film, as well as preferably a secure closure to avoid or at least substantially deter heat leaks (thermal transfer) and to provide some water proofing or retarding capabilities for rain protection, with or without the use of bubble wrap.
4. In the exemplary packaging and delivery application, in which the insulating packaging and related packaging system of the present invention is disclosed as an exemplary application (not directly part of the present invention, which is the subject matter of the parent application), a time/temperature alert product (which can be, for example, an enzyme-based product) which is activated when the perishable groceries are packed by the purveyor. The alert signals "safe," at least if the temperature does not exceed a preset or predetermined temperature, and preferably also if the time since activation does not exceeds a preset or predetermined time. If either the elapsed time or temperature is exceeded, the alert signals an "alarm," and the customer knows that either the elapsed time and/or the temperature has been exceeded and the perishable items are not warranted by the purveyor to be safe. In the exemplary application aspects of the invention, if the alert signals an "alarm," the customer is responsible for contacting the purveyor to, for example, arrange for a pickup of the now unwarranted goods to be returned to the purveyor. The latter may be done at either no charge to the customer or at some charge if the customer went beyond the agreed to time range of delivery before opening the packaging of the goods to put at least the perishable goods away in the refrigerator/freezer, as appropriate.
5. An innovative "business method" or physical methodology (preferably computerized) to insure that the purveyor knows at least approximately when the customer has opened the box of groceries, while preferably also providing other useful information. This can be accomplished by, for example, a automated tracking system which involves in its preferred embodiment the use of a unique transaction identifying alphanumeric code, which the customer is obligated to transmit to the purveyor, preferably through an automated telephonic or telecommunications system. However, again this is not directly part of the present invention but rather is part of the parent application's invention.

In the exemplary application (but again not directly part of the present invention), this involves, for example, a card packed in or placed on the top of the preferred covered, corrugated box. The card preferably is prepared at the same time as the bill of lading or other like record for the shipment. The card preferably has a unique number (purely numeric or in alphanumeric form) assigned to the shipment, which preferably is printed or otherwise provided on the card.

To complete the delivery transaction of the exemplary application, which again is not directly part of the present invention, the customer preferably is required to call a telephone number provided by the purveyor or otherwise telecommunicate with the purveyor via, for example, a computer connected to the purveyor's web site on the Internet, which in turn is tied into the purveyor's computerized data base. Thus, the telephone number or other telecommunication preferably automatically interfaces or connects to the purveyor-controlled computerized database. The customer preferably punches or keys in the unique number from the card, which in sending the alphanumeric information also automatically informs the purveyor of the date, and inferentially the time that the customer opened and unpacked the groceries.

It should be noted that, in using the term "telecommunicate" herein, such is generally intended to broadly cover computer-to-computer communication, including not only hard-wired telephonic or telecommunication lines but also wireless or satellite communication links.

If the customer does not "call" in, the purveyor's computer preferably will call the customer's telephone number, for example, repeating every ten (10) minutes until successfully answered and responded to, for a pre-set time period of time (e.g. one hour or, alternatively, for as long as the allowed time period between packing and opening the package has not elapsed), with a recorded message that provides data entry instructions. This serves to remind the customer to, for example, punch in the unique number on the telephone keypad when prompted by the purveyor's computerized messaging and data receiving system and, if the call is not at the time of opening the delivered package, when the package was opened and the perishable food appropriately refrigerated.

This entire method of the exemplary application of the insulating, packaging material and related packaging system of the present invention protects the purveyor since the purveyor will know at least the approximate time that the customer opened the delivered groceries and determine whether the perishable goods are within the warranty period. If no unique identification number is ever entered into the purveyor's computer or computer system, the purveyor will have sufficient reason to, for example, void warranty on that grocery delivery, since the customer did not uphold his/her end of the implied or written contract or oral agreement. The terms of this kind of grocery delivery contract or arrangement preferably is explained to the customer at time of order entry and fortified over time by customer action on subsequent deliveries until it becomes an ingrained customer habit and preferably is covered at the time the customer originally subscribes to the service, at which time a written agreement preferably is entered into containing appropriate provisions detailing the arrangements and warranty with respect to the delivery of perishable goods. The purveyor is further protected, since the alpha-numeric number, cannot be entered by the customer before the delivery is made, since the card is enclosed in the sealed box prior to that time.

Additionally, a "calculator," preferably computerized and preferably tied into the purveyor's computerized order receiving system, is used which, based on extensive and continuing test experience, is capable of predicting the recommended nature and volume of, for example, the cooing/heating source and the other packing materials that should be used to insure a successful shipment of particular perishable foods. Some variables involved preferably include inter alia the time of year or ambient weather condition, destination location, transport method, projected transit time, perishable product (s) being delivered, etc.

The "calculator," using standard and special algorithms, is applicable to slide rule, electronic calculator and computer software, with the latter being much preferred. For example, in the purveyor's entering the ordered groceries, which order includes one or more perishable items, the computerized system using automated evaluation algorithms and any needed supplemental data input from the data processor operator, preferably automatically calculates and informs the purveyor's shipping department what package configuration (items 1-3 above) should be used for the order involved. Updating data tracking of the number of "successful" vs. "unsuccessful" deliveries of the perishable goods and the details of the shipments involved likewise preferably are used to intelligently update the calculator algorithms.

In the foregoing, the exemplary application for the packaging material and packaging system of the invention has been keeping perishables item(s) cold with the various elements or components of the present invention described, with the perishables involved being in many forms (primarily foods, but also applicable to pharmaceuticals, medicines, organ transplants, confections, floral related products, etc.), with grocery delivery as the primary example. However, it should be understood that the packaging principles of the invention are also applicable to the extreme problem of delivering groceries (or other perishable goods) in overly cold environments, such as, for example, in Duluth, Minn. in February. In such a situation, the perishable groceries (milk, eggs, cheese, lunch meat, etc., which typically are only refrigerated) need to be protected from becoming too cold and, for example, from freezing into a solid mass.

This is a tougher challenge, as the cool groceries must be kept at acceptable refrigerator temperatures [e.g., from about thirty to thirty-three (30-33°) degrees F. (comparable to a cold refrigerator) up to about 40-45 degrees F. (comparable to a warm refrigerator), while also using a temperature affecting, warming device in ambient conditions that can get as low as, for example, minus thirty (−30°) degrees F. wind chill. Thus, the packaging of the invention of the fragile or perishable groceries being delivered preferably must keep them from getting much above about forty-five (45°) degrees F., while also maintaining them above about thirty to thirty-three (30-33°) degrees F. or possibly lower, depending on the particular, usually refrigerated, perishable involved. For example, milk can be allowed to go down to a temperature much lower than thirty to thirty-three (30-33°) degrees F., without harm, for example, down to about twenty-three (23°) degrees F., with the actual allowed lower temperature being dependent on, for example, the amount of butter content. Even with the allowably low temperature of twenty-three (23°) degrees F., there is still a potential temperature difference of approximately fifty-three (53°) degrees F. with the extremely low temperature of the ambient.

In such an extremely low ambient temperature situation, for example, well below zero degrees F., a supplemental material, for example and preferably, bubble wrap, preferably is used to line the interior wall surfaces of the a corrugated box container, with the bubble wrap being applied to at least the bottom and preferably on all of its interior wall surfaces, including its four side walls and its bottom and top. The bubble wrap helps keep heat inside the box, this time by delaying thermal transfer to the outside via conductive heat.

Additionally, preferably inside the box interior bubble wrap is a layer of heated, hydrated packet material, which has been hydrated and heated in, for example, a microwave oven. The packet material is heated to, for example, over one hundred (100°) degrees F. just before it is to be used. Inside the layer of heated, hydrated packet material preferably is a second layer of bubble wrap that slows the heat from being conducted from the heated packet material into the perishable foods, which are located in the innermost chamber or area. Both layers of bubble wrap preferably are configured with the bubble side toward the hydrated packet material to increase the volume of trapped air that acts as a thermal barrier at those facing surfaces.

Thus, in this extremely low ambient temperature situation, the perishable food items are initially packed in frozen packet material in, for example, the same fashion as they would in a warm ambient temperature environment. Then a first, all encompassing, surrounding layer of bubble wrap is provided around the cold temperature protected perishable goods, with its bubble side out, then an all encompassing layer of heated (or, as noted below, an unheated but hydrated) packet material is placed around the bubble wrapped, cold protected goods, then another, all encompassing layer of bubble wrap is provided via the interior, layered walls of the box container with its bubble side in, and then comes, or course the walls of the box container itself and the outer protective cover.

Thus, once the box is packed and sealed, preferably an outer, protective, black, heavy gage, plastic film cover is used to cover the entire box container. The gage of the film can be similar to the protective, metallized cover described above, but without the need for the metallized layer, and the preferred material for the plastic is polyethylene. Like the metallized film cover used for pure cooling applications, the black cover for the heating application preferably is constructed with a lip having a two-sided, tape sealing mechanism.

Although for very extreme, low ambient temperature conditions the heating of the intermediate layer of packet material may be desirable, in some conditions, merely hydrating the packet material is sufficient without any heating, with the unheated and initially unfrozen packet material serving as a "cold sink," absorbing the extreme cold from the ambient until it itself becomes frozen, thereby greatly assisting in the prevention of the extremely cold ambient reaching the usually refrigerated perishable in the innermost chamber of the packaged box.

The foregoing techniques for combating extremely low ambient temperatures are primarily directed to normally refrigerated, perishable goods. Certain frozen foods, such as, for example, ice cream, on the other hand, effectively have no limit to the temperature they may go down to, and, therefore, is typically not of concern in such extremely low, ambient temperatures.

Like the exemplary, pure cooling applications, the exemplary, heating application is subject to many variations in configurations and combinations.

BRIEF DESCRIPTION OF DRAWINGS

For a further understanding of the nature and objects of the present invention, reference also should be had to the following detailed description, taken in conjunction with the accompanying drawings, in which like elements are given the same or analogous reference numbers, and wherein:

FIG. 12 is a side, cross-sectional view of a section of the packet sheet embodiment of FIG. 11; while

FIG. 14 is a perspective view showing a part of the packet sheet roll of FIG. 13 used to wrap an exemplary fish as a further, exemplary perishable grocery or seafood item, as an example application of the packet sheet material used as an element in the preferred embodiment of the present invention; while

EXEMPLARY MODES FOR CARRYING OUT THE INVENTION

Preferred Protective Packing Approaches (FIGS. 2-9)

The preferred, exemplary embodiment of the present invention provides a "safe delivery™ system for perishable goods, including groceries, which keeps the cost as low as possible for the purveyor, allowing the purveyor to use some components, e.g., corrugated boxes that likely are already in inventory. Several other elements are involved to solve the total problem. Some are tangible products and some are tangible instruments used in combination with business methods; both used to plan and verify successful shipments. All of the system elements are listed below, with reference primarily to FIGS. 2-9:

1. An appropriate container 100 (note FIGS. 4, 6, 7 & 8) for the perishable groceries, preferably rigid or at least self-supporting in its structure, and preferably a relatively inexpensive version of a corrugated cardboard box 100 (e.g., one with a single flute) or corrugated material, used to contain the perishable groceries 120/120'. Variations of corrugated boxes, such as, for further example, ones with double flutes, may be used, if desirable for certain applications.

Figure 2:
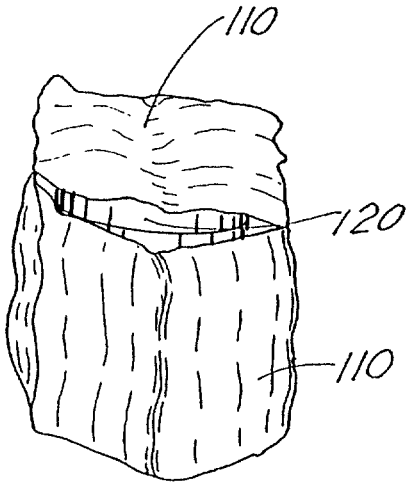
FIG. 2 is a side, perspective view of a frozen perishable grocery item (e.g., ice cream), inserted in a pouch-equivalent wrapping with a top cover of packet sheet material made in accordance with an embodiment of the packaging material of the present invention, which pouch and top cover provide a surrounding source of coldness to the grocery item, as used in the preferred embodiment of the system of the present invention.
Figure 3:
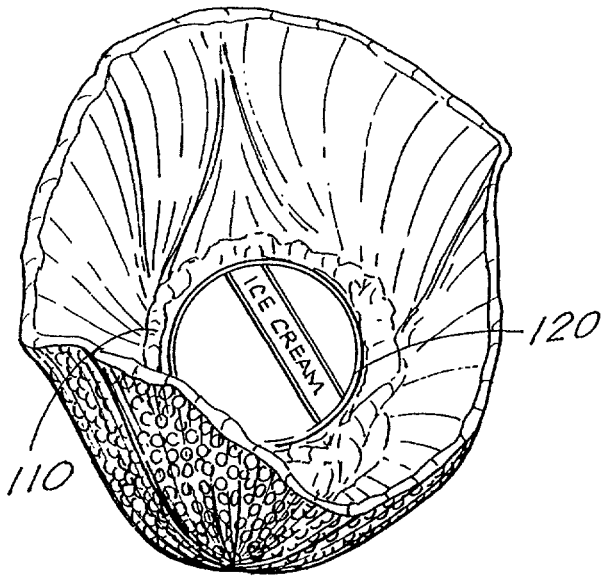
FIG. 3 is a top, perspective view of the frozen perishable grocery item (e.g., ice cream), inserted in the pouch-equivalent wrapping with top cover of packet sheet material providing a surrounding, encompassing source of coldness to the grocery item, as in FIG. 2, but now inserted into a further, individualized pouch of three ply material, including an inner foam ply and an outer bubble wrap ply with an intermediate metallized film ply, with the cover top of packet material shown in FIG. 2 being temporarily removed (shown in phantom line) to show the ice cream content, used an exemplary, preferred embodiment of the packaging material of the present invention.

2. At least one source 110 or 110*a* of cold (or heat as may be needed) appropriately affecting the temperature inside the container 100 to maintain the temperature inside the box within the desired or acceptable temperature range. An individual, specific perishable item source 110 could be used as illustrated in FIGS. 2 & 3, or, alternatively, an all-encompassing source 110*a* could be used as a substitute or a supplement (see FIGS. 5 & 6). The preferred cold/heat source 110/110*a* is made up of "ThermaFreeze"™ sheet packet material 110 (10, see FIGS. 11-13) using a hydrated, super-absorbent polymer (14, note FIG. 12), which is hydrated (14', note FIG. 12A) and then can be either frozen (e.g., in a freezer) or heated (e.g., in a microwave oven), as needed, which hydrated packet material affects the temperature of the environment (e.g., enclosed perishable groceries 120/120') and maintains it for an appropriate period of time (e.g., 4-6 hours or longer), without producing moisture as the packet material warms up or thaws (in a cooling application) or cools down (in a heating application) because the contained "water" sublimes.

Tests prove that the total time required for the "thawed" but still partially hydrated packets 17 to become entirely flat (containing no "water"; note FIG. 12) is six to eight (6-8) days. In the initial period, after the packets 17 are thawed, there is also an evaporative cooling effect due to the ultra-slow release of "water" vapor that tends to slow temperature rise. In addition, in either the frozen or the thawed state, the packet material tends to act as an additional thermal barrier, slowing thermal intrusion from conducted heat.

For refrigerant or cooling situations, some purveyors of perishable groceries may use as a supplement to or substitute for the sheets of packet material, for example, less efficient, gel packs or dry ice, by individual preference or other requirement, although, as noted, the hydratable packet material 110/10 containing a super-absorbent polymer 14/14' is much preferred.

3. For cooling applications (cold source 110/110*a*), preferably an outer, radiant energy protective cover 130 for the entire box 100 is used. The preferred cover 130 is a one, two or three (1, 2 or 3)-ply "ThermaBarrier"™ cover for the entire box 110 to protect the box and its contents (including one or more items of perishable groceries 120/120') from heat from radiation (e.g., sunlight). The balance of the structure or packing inside the heat insulating cover (corrugated box 100, hydrated packet material 110/110*a*, bubble wrap material 140) presents a series of barriers to heat attack from convection (e.g., hot air movement) and/or conduction (e.g. heat transferred from other objects in contact with the package structure). The cover 130 also protects the preferred corrugated cardboard box against rain (or snow or slush in a heating situation).

The cover 130 preferably includes a metallized film 141, with an emissivity rate of about ninety-four (94) or better. The basic metallized film raw material is typically referred to as a "radiant barrier." The preferred embodiment is a metallized film 141/142 produced by vacuum depositing a thin, outer layer 141 of aluminum, or other high emissivity metal, on a heavy-gage plastic film 142 (note FIG. 22). The preferred plastic film 142 is polyethylene, although other molecular structures may be used. As an alternative to vacuum depositing of a meta (141), a foil layer may be laminated to the plastic film substrate.

Figure 22:
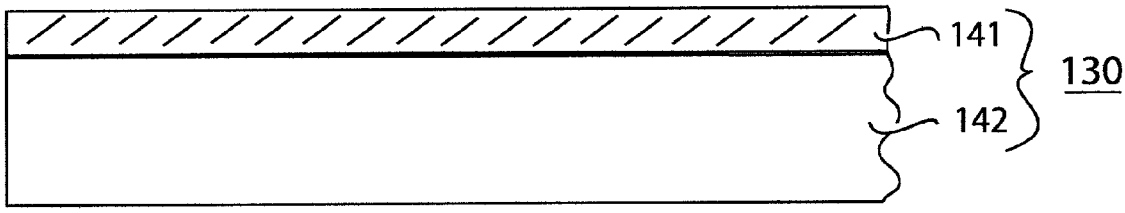
FIGS. 22-25 are side, cross-sectional views of the various, exemplary embodiments of the insulating packaging material of the present invention, including a one (1) ply embodiment, two (2) exemplary embodiments of two (2) ply material and a three (3) ply embodiment, respectively. Although the single ply packaging material of FIG. 22 is not claimed by itself, in combination with the other packaging elements, it is included as part of the currently preferred packaging system of the present invention.
Figure 23:
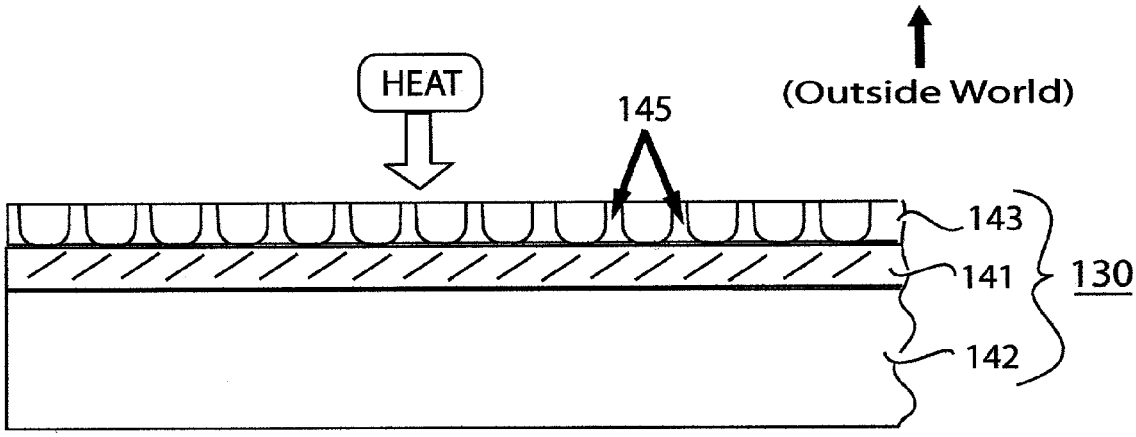

The cover 130 also may be made up of two or more layers or plies of material, preferably with the outer metallized surface layer 141 on the plastic film layer or substrate 142, as described and considered as a single ply or layer in FIG. 22, and preferably a bubble wrap layer using, for example, three-sixteenths ($3/16^{th}$) bubble wrap 143 as an exterior layer (see FIG. 23). A further alternative (see FIG. 24) is to use a foam layer 144, similar or identical to the Pactiv product "Microfoam"® material, in place of the combined plastic layer 142 and metalized layer 141.

Figure 25:
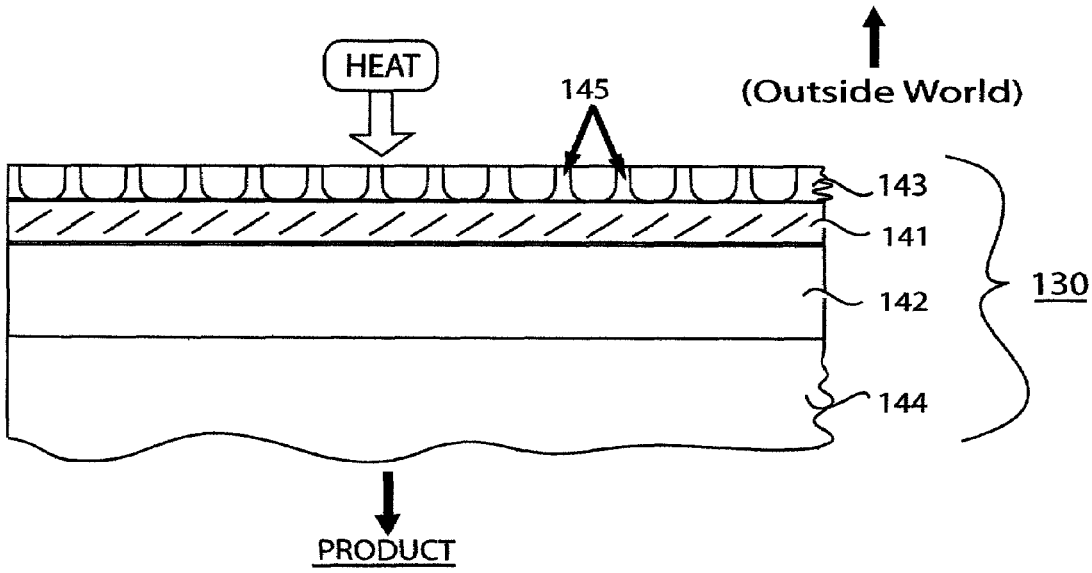

With reference to FIG. 25, a three-ply material that uses, for example, a foam layer 144 similar or identical to the Pactiv product "Microfoam"® could be used, with the foam as an interior or middle layer, between the metallized, plastic film layer 141/142 and the bottom bubble wrap layer 143. An exemplary foam comprises a stable, plastic foam made from polypropylene and polyethylene films with anti-static and coloring additives.

Figure 24:
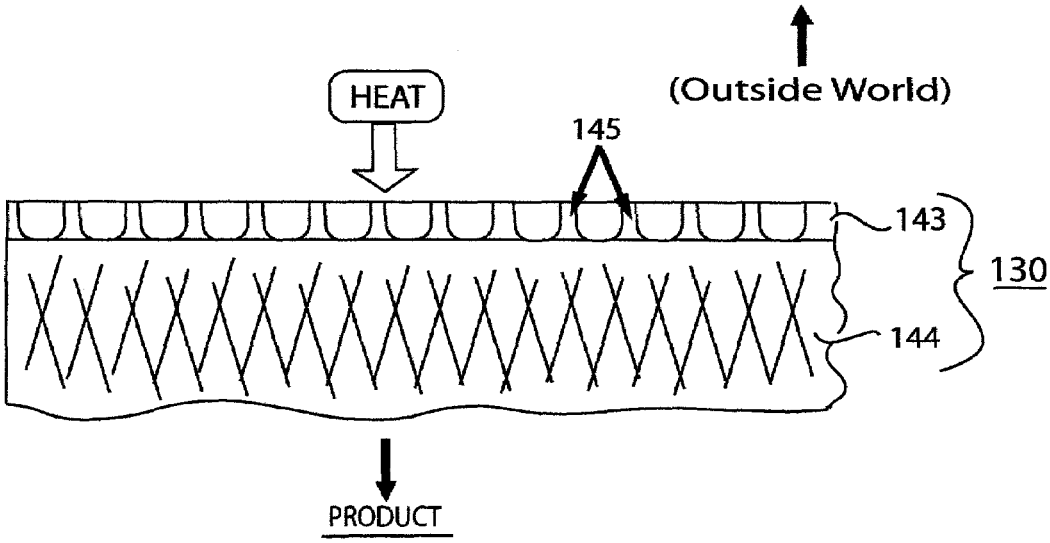

When using a bubble wrap layer 143 it is important that the bubble side be placed against the other layers (e.g., against the flat metallized plastic film 141/142 as in FIGS. 22 & 25, and against the foam layer 144 as in FIG. 24) to create a number of insulating pockets 145 of air or other gaseous medium present in between the sides of the bubbles and the interface with the facing layer of material (141/142 or 144). As should be understood from the foregoing, the flexible bubble wrap material 143 has at least one side having a series of bubbles thereon, each bubble having an outermost surface, the first ply and the second ply or layer being associated together with the outermost surfaces of the bubbles being in contacting, face-to-face, interfacing engagement with the flat, mettalized surface 141, forming a multitudinous series of pockets of gaseous media between the bubbles and the flat surface, enhancing the temperature insulating characteristics of the packing material.

Regardless of the number of plies and the outer layer material used, the cover 130 preferably is water proof or at least water retardant to protect the preferred corrugated cardboard box container 100 from rain, etc.

An appropriate protective, outer cover preferably is also used where a heat source is included to, for example, combat extremely low, i.e., well below freezing temperatures.

The protective, outer cover 130 preferably also includes a secure closure 133 to avoid heat leaks (convection) and to further ensure the water-proof or retardant characteristics discussed above. The preferred closure 133 is a double sided, adhesive tape (such as that used in laying carpet), since it provides a highly secure closure. Such tape also allows reusability on the same cover for, for example, at least ten times. Other exemplary closures include "Velcro"® or other "hook & loop" type materials and/or other types of double-sided tape or other forms of closures.

Figure 14:
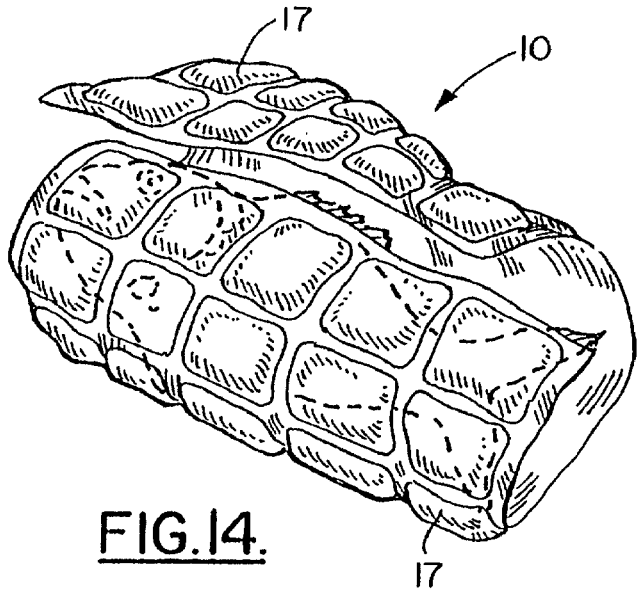
Figure 15:
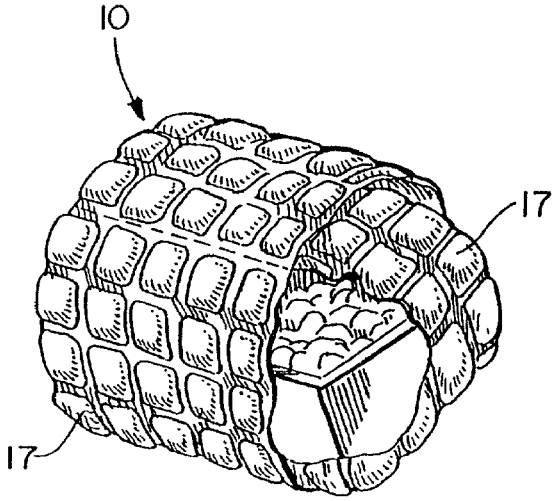
FIG. 15 is a perspective view showing a part of the packet sheet material roll of FIG. 13 used to wrap an exemplary box of temperature-sensitive material as a further example application of the packet sheet material used as an element in the preferred embodiments of the packaging system of the present invention.

Internal pouches and sleeves and wrappings or other forms of enclosing elements (note, for example, pouch-equivalent wrappings 110) are used for individualized, "super protection" of highly temperature sensitive products, such as the illustrated ice cream 120 of FIG. 2, fresh chicken and fresh fish (note FIG. 14), etc. FIG. 15 likewise shows a part of the packet sheet material roll of FIG. 13 used to wrap an exemplary box of temperature-sensitive material as still a further example application of the packet sheet material 10 preferably used as an element in the preferred packaging system embodiment of the present invention.

These internal protective "pouches" or enclosing, encompassing wrappings are also applicable to other types of products, such as, for further example, pharmaceutical preparations, clinical laboratory specimens, etc.

Figure 5:
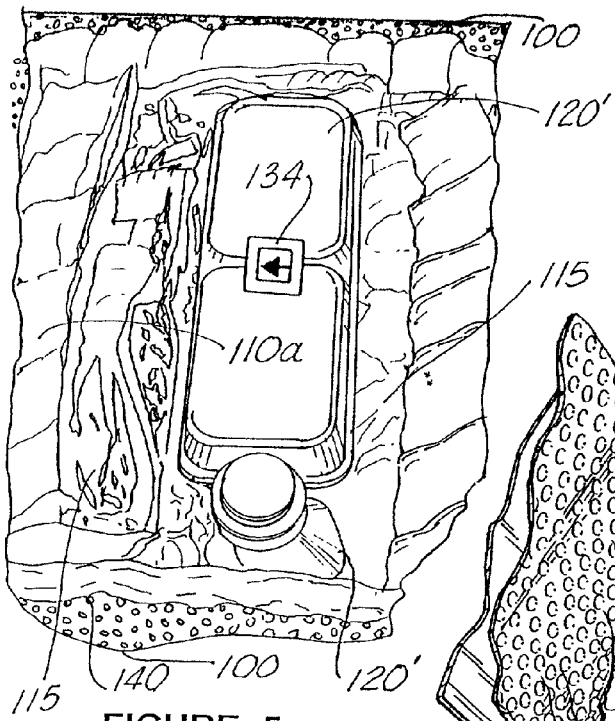
FIG. 5 is a top, perspective view showing other types of perishable grocery items (e.g., eggs & milk) that, when stored, are cooled or refrigerated but not frozen, inserted in an all-encompassing pouch of hydrated, frozen, packet sheet material providing a source of coldness to all of the enclosed grocery items, including the perishable grocery items of eggs & milk), with the pouched groceries inserted into the bubble wrapped interior of the box of FIG. 4, and using the exemplary preferred embodiment of the packaging material and packaging system of the present invention.

As analogously noted above, such pouch and sleeve products likewise may be a single-ply, metallized film 141/142 (acting as a cold environment containment) and/or a two-ply product comprising a ply of metallized film 141/142 (or foam layer 144) and an outer ply of bubble wrap 143, using the preferred three-sixteenths ($3/16^{th}$) bubble wrap applied with the bubbles, rather than the flat side, against the metallized surface of the film (or outer surface of the foam layer). A third configuration would include, for example, an inner foam ply (again, for example, using a foam similar to Pactiv's "Microfoam"® product). The selection of specific ply structure is a function of the degree of protection required across the time period desired. Exemplary pouches with a metallized outer surface are shown in FIG. 5.

The assignee's "ThermaBarrier"™ 1-Ply is a metallized film (141/142) that repels radiant energy from sunlight from the surface of the material; while assignee's "ThermaBarrier"™ 2-Ply is the metallized film that includes an outer covering of bubble wrap (preferably $3/16^{th}$) 143 that is laminated to the first ply with the bubbles (not the flat side of the bubble wrap) against the flat, metallized film 141. This configuration doubles or otherwise increases the thermal protection of the bubble wrap since it doubles or otherwise increases the volume of air trapped between the plies.

Assignee's "ThermaBarrier"™ 3-ply material includes a layer (e.g., a $1/8^{th}$ or ¼" in thickness) of foam (144; similar to "Microfoam"® produced by Pactiv, Inc.) with one metallized side. Bubble wrap (143) forms the third ply and is laminated to the outside, i.e., the metallized surface 141. The material is preferably used in the form of a pouch, wrapping with a cover or a liner with this 3-ply configuration.

For example, a three (3)-ply "ThermaBarrier"™ pouch preferably is used inside the preferred corrugated box 100 to contain especially temperature sensitive food products, such as, for example, ice cream 120, etc.

The pouch materials is comprised of foam (similar to the Pactiv product named "Microfoam"™) 144 that can be an eighth or a quarter ($1/8^{th}$ or ¼") inch thick or some other effective thickness. The foam layer 144 can be used either by itself or with one side metallized for radiant energy protection. In the preferred example, the metallized version is used. The third ply is common bubble wrap 143. This same configuration can be assembled by forming the metallized film into an outer "shell" designed to have a foam insert (similar to the Pactiv product named "Microfoam"®), produced without a metal layer. The shell may or may not have a three-sixteenth ($3/16^{th}$) bubble wrap laminated to the outer surface. However, whenever bubble wrap is used, it preferably is applied to the outside layer of the pouch with the bubbles, not the flat side of the bubble wrap, against the outer (i.e., metallized) side of the foam. That configuration doubles or otherwise increases the barrier protection against conductive heat by trapping, for example, twice the amount or some other increased amount of air than is trapped if the bubble wrap were applied with the flat side against the outer layer of the foam ply.

4. A time/temperature alert product 134 (note FIG. 5), which can be, for example, similar to that of or identical to a Swedish product named "VitSab"®. This enzyme-based product using enzymatic color indicators is activated by the purveyor's packer when the groceries are packed and it is either placed in with the packed perishable goods or attached to the outer surface of the covered container 130/100, depending on what factors are being monitored and how many monitors are being used. If the preferred, single monitor is being used to show whether either the maximum set temperature has been exceeded or the maximum allowed time elapsed has been exceeded, the monitor is placed in the interior of the packaging with the perishable goods. On the other hand, if only the maximum elapsed time is being monitored or is being separately monitored, the monitor **134*a* (note FIG. 9) can be placed on the exterior of the covered box 130/100**.

The preferred "VitSab"® monitor 134 comes in the form of a substantially flat member with an adhesive back and two, juxtaposed, sealed, rectangular sections with a centrally located, sealed, circular "button" over-lapping the two rectangular sections on its front. The "button," when sufficiently pressed, breaks the seals and causes an enzyme mixture to be created, activating the monitor and the two rectangular sections, one effectively monitoring the elapsed time from actuation up to a maximum time period and the other the temperature reached up to a maximum. If the pre-designed, maximum elapsed time is exceeded, its rectangular section, normally green in color, turns to the color yellow; while if the pre-designed maximum temperature is exceeded, its rectangular section, normally green, likewise turns to the color yellow. Thus, if either rectangular section has changed to yellow by the time the customer opens the packaged goods, the warranty is effectively terminated under the currently preferred methodology.

Thus, the alert signals "safe" if the temperature does not exceed the preset or predetermined temperature and if the time since activation does not exceeds the preset or predetermined time. If the elapsed time or set temperature is exceeded, the alert effectively signals an "alarm," and the customer knows that either the elapsed time and/or the temperature has been exceeded, and the perishable groceries or other products are no longer warranted. If the alert signals an "alarm," the customer preferably is responsible for contacting the purveyor for a return of the goods in the preferred methodology of the invention.

Figure 9:
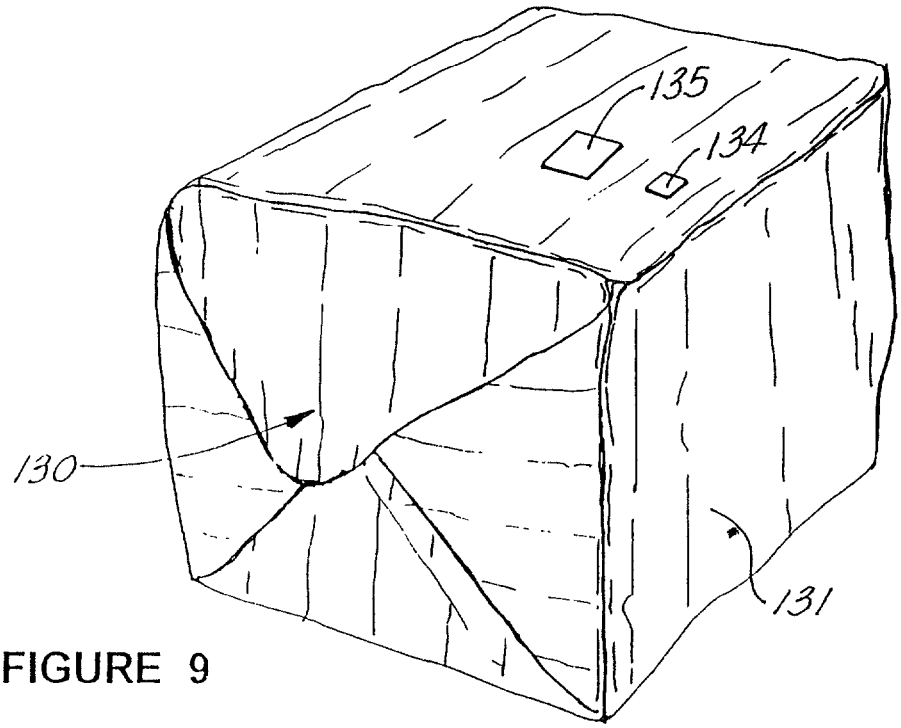
FIG. 9 is a top, perspective view of the elements of FIG. 8, but with the outer pouch top fully pulled over the top of the box and with the pouch top secured over the box, with the box having its transaction identification card and temperature and monitoring element both affixed to the top of the box, with the packaged groceries or other perishable product now ready to be protectively delivered, as part of an exemplary application using the exemplary preferred embodiment of the packaging material and packaging system of the present invention.

As an alternative, if it is desired to only monitor the maximum allowed elapsed time from packing to opening, a single monitor **134*a* is used and preferably is attached to the outside of the covered, sealed box 130/100 as illustrated in FIG. 9**.

Whichever is the case, the monitor **134/134*a* typically will be applied to or otherwise used on a backing card, which preferably includes printed instructions for the customer with respect to calling the purveyor when the package is opened and what the displayed color(s) on the monitor mean. In the latter instance, that is, with respect to using the time elapsed monitor 134*a* on the exterior of the covered box, the unique alphanumeric code or transaction identifying code (see below) could be applied to the informational part of the monitor backing card, and, in essence, the cards 134*a* and 135** combined into one.

5. An innovative "business method" or tangible methodology (preferably computerized) to insure that the purveyor knows at least approximately when the customer has opened the covered box 130/100 of groceries. This involves, for example, a card 135 (note FIG. 9) packed in or placed on the top of the preferred, covered, corrugated box. The card 135 preferably is prepared at the same time as the bill of lading or other like record for the shipment. The card 135 preferably has a unique number (purely numeric or in alphanumeric form) assigned to the shipment, which preferably is printed on the card.

To complete the delivery transaction, the customer preferably is required to call a telephone number provided by the purveyor or otherwise telecommunicate with the purveyor via, for example, a computer connected to the purveyor's web site on the Internet. The telephone number or other telecommunication preferably connects to a purveyor-controlled computerized database. The customer preferably punches or keys in the unique number from the card 135, which in sending the alphanumeric information also automatically informs the purveyor of the date, and inferentially the time that the customer opened and unpacked the groceries. It should be noted that, in using the term "telecommunicate" herein, such is generally intended to broadly cover computer-to-computer communication, including not only hard-wired telephonic or telecommunication but also wireless or satellite communication links.

If the customer does not "call in" within a set elapsed time, the purveyor's computer system preferably will call the customer's telephone number, for example, every ten (10) minutes preferably for a preset period of time, for example, an hour, with a recorded message. This serves to remind the customer to, for example, punch in the unique number on the telephone keypad when prompted by the purveyor's computerized messaging and data receiving system.

This entire method protects the purveyor since the purveyor will know at least the approximate time that the customer opened the delivered groceries. If no unique identification number is ever entered into the purveyor's computer or computer system, the purveyor will have sufficient reason to, for example, void warranty on that grocery or other type of product delivery, since the customer did not uphold his/her end of the implied or written contract or oral agreement. The terms of this kind of grocery delivery contract or arrangement preferably is explained to the customer at time of order entry and fortified over time by customer action on subsequent deliveries until it becomes an ingrained customer habit and preferably is covered in allowing the customer to originally subscribe to the service, at which time a written agreement preferably is entered into containing appropriate provisions detailing the arrangements and warranty with respect to the perishable goods.

Additionally, a "calculator," preferably computerized, is used which based on extensive and continuing test experience, is capable of predicting the recommended nature and volume of, for example, "ThermaFreeze"™ refrigerant and of the other protective materials required to insure a successful shipment. Some variables involved preferably include inter alia the time of year and/or ambient weather condition, destination location, transport method, projected transit time, product being delivered, etc. The calculator, using standard and special algorithms, will be applicable to slide rule, electronic calculator and computer software, with the latter being preferred. For example, in the purveyor's entering the ordered groceries or other products, which order includes one or more perishable items, the computerized system using automated evaluation algorithms and any needed supplemental data input from the data processor operator, would automatically calculate and inform the purveyor's shipping department what package configuration (items 1-3 above) should be used for the order involved. Updating data tracking of the number of "successful" vs. "unsuccessful" deliveries of the perishable goods and the details of the shipments involved likewise preferably are used to intelligently update the calculator algorithms.

Figure 10:
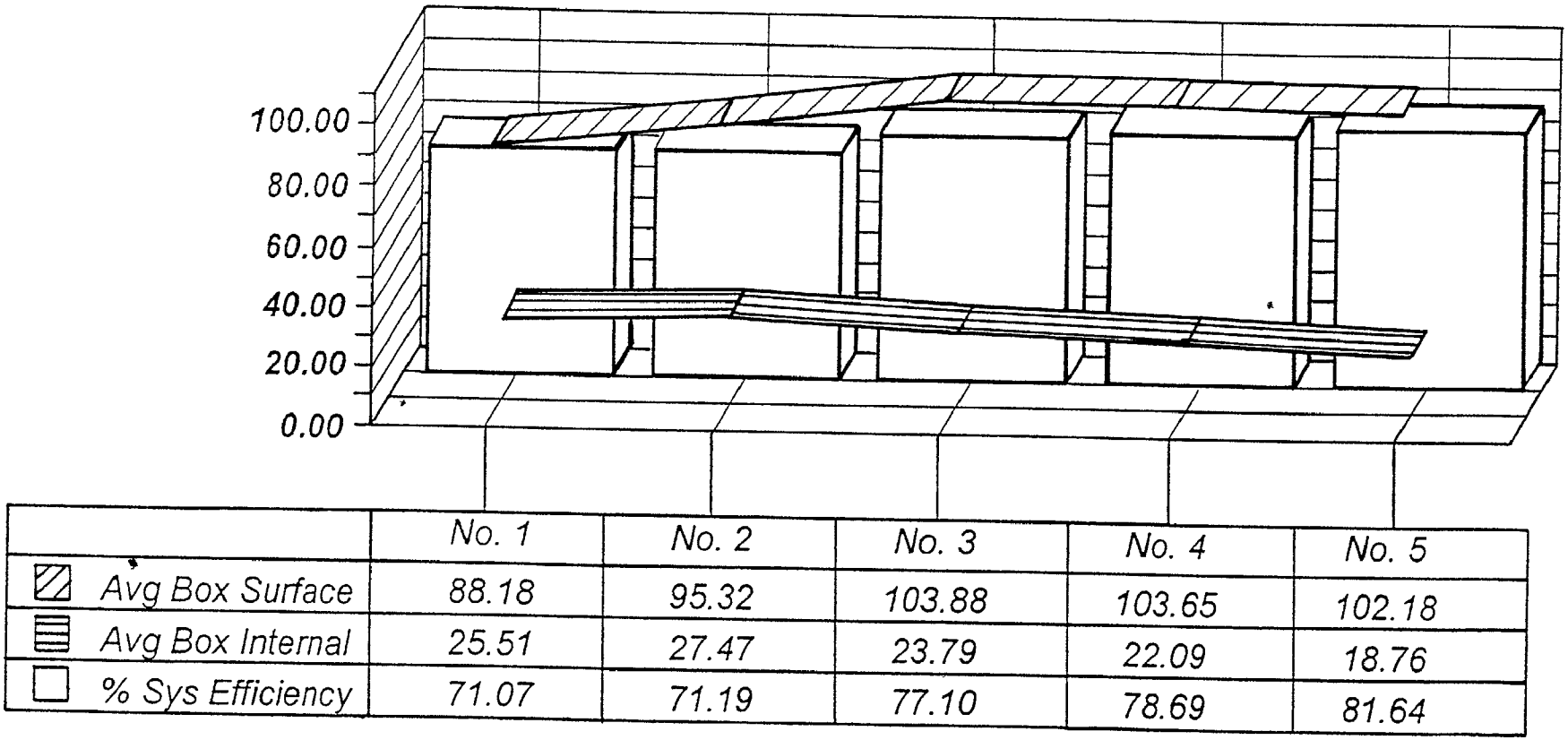
FIG. 10 is a graph detailing the combined test results of a series of five tests run over approximately a week of time in a hot summer month in a deep south town, in which the exterior surface temperature of the box in direct sunlight is graphed against the protected interior of the box over a six hour period, providing an analysis of the exemplary, preferred packaging system's percent efficiency achieved with exemplary embodiments of the present invention.

Further, exemplary variants for the groceries or other products packing for the bubble wrap include:

1. A single sheet of bubble wrap 140 laid in the bottom of the corrugated box 100 before loading the "ThermaFreeze" sheet material and groceries or other products in. The presence of the bottom layer of bubble wrap tends to slow conductive heat that attacks the bottom of the box from, for example, a concrete shipping dock or asphalt patio or walkway if the groceries or other products are left in such a location. This configuration has been tested, and the results are shown in the graph of FIG. 10 as the last test (Test No. 5).
2. Along the same protection approach, using bubble wrap 140 around the sides and top of the grocery "payload" (between the walls of the corrugated box 100 and the groceries), in addition to the sheet laid in the bottom, should likewise be effective and is illustrated, for example, in FIG. 4, especially for longer delivery time frames [such as, for example, eight (8) hours] and with other "ThermaBarrier"™ protective configurations, up to four (4) or more days.
3. Again, along the same approach, using bubble wrap (140) laminated to the inside of the corrugated box 100 as a standard by a box manufacturer under license should also be effective, and such a box, it is believed, is unique.

As previously noted, when the bubble wrap (140) is used, preferably it is applied with the bubbles of the wrap facing the corrugated box wall 101 (note FIG. 8), rather than facing towards the "payload" zone. The reason again is to double or otherwise increase the volume of trapped air between the corrugated box and the "payload" by trapping the air in pockets or areas between the bubbles against the box wall. The trapped air provides a good thermal barrier against conducted heat. (An exception to this is when the ambient temperature is extremely low and a heated (or unheated but hydrated) "pouch" of packet material is used within the bubble wrap layered box to counter or absorb the ambient cold, in which case the bubble wrap is placed preferably with the bubble side toward the box interior, that is, toward the outer surface of the exterior pouch of packet material.)

In the foregoing, the primary application has been keeping perishables cold with the various elements or components described, with the perishables involved being in many forms (primarily foods, but also applicable to pharmaceuticals, medicines, organ transplants, confections, floral related products, etc.) with perishable grocery delivery as the primary example. However, it should be understood that the principles of the invention are also applicable to the extreme problem of delivering groceries (or other perishable goods) in overly cold environments, such as, for example, in Duluth, Minn. in February. In such a situation, the normally refrigerated, perishable groceries (milk, eggs, cheese, lunch meat, etc.) need to be protected from becoming too cold and, for example, from freezing into a solid mass.

This is a tougher challenge, as the cool groceries must be kept at acceptable refrigerator temperatures for non-frozen, perishable groceries 120' such as milk, eggs, orange juice, etc. [e.g., above about 30-33 degrees F. (comparable to a cold refrigerator) up to about 40-45 degrees F. (comparable to a warm refrigerator)] with a temperature affecting, warming device in ambient conditions that can get as extremely low as, for example, −30 degrees F. wind chill. Thus, the packaging of the fragile groceries being delivered must keep the perishables from getting much above about 45 degrees F., while also maintaining them above about 30-33 degrees F. (or above a lower temperature depending on the particular perishable involved). To effectively serve as a low temperature minimum, the packet material need not necessarily be heated and, for example, by just using hydrated, but neither initially frozen nor heated, packet material, the hydrated packet material can serve as a cold-absorbing, thermal barrier, which, until the super-absorbent polymer 14 of the packet material itself freezes, the contained temperature sensitive, perishable goods stay at a safe, acceptable temperature for the perishables.

Figure 4:
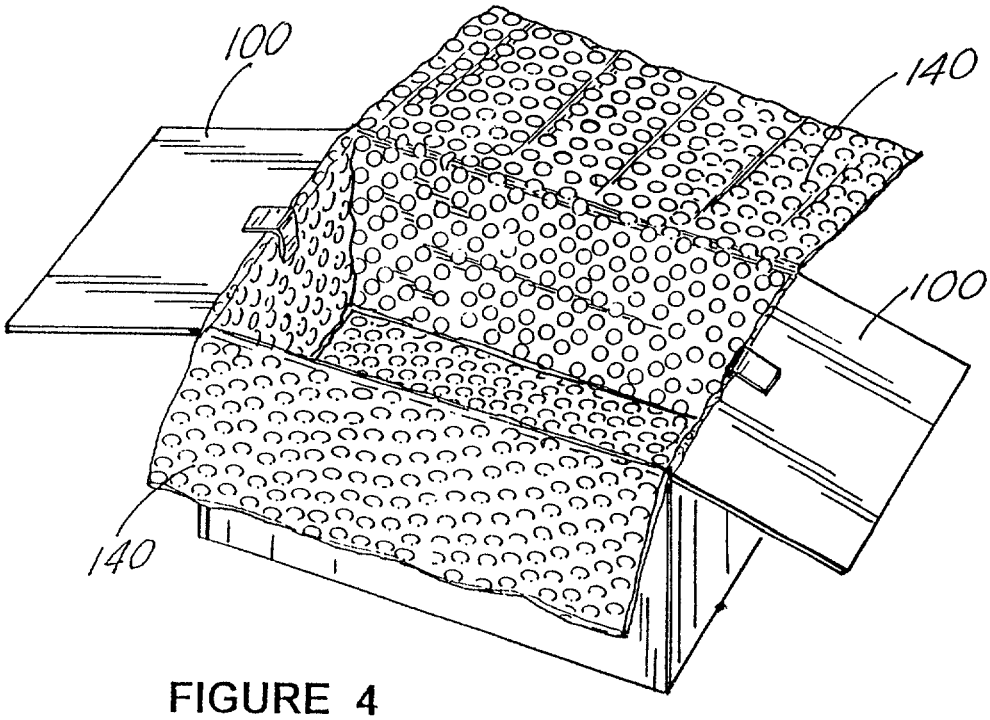
FIG. 4 is a top, perspective view of an outer, cardboard container box for inter alia the cold wrapped and pouched, frozen perishable grocery item (e.g. ice cream) of FIGS. 2 & 3 (not illustrated in this figure in order to more clearly show the interior of the box), which further includes an interior layer of bubble wrap material, using an exemplary preferred embodiment of the packaging material and packaging system of the present invention.

In such a situation preferably a corrugated box 100 lined with bubble wrap 140, such as that illustrated in FIG. 4, is used. The bubble wrap 140 helps keep heat inside the box 100, this time by delaying thermal transfer via conductive heat. Preferably inside the bubble wrap 140 is a layer of heated "ThermaFreeze" packet material 110*a* (10; in similar fashion to the arrangement shown in FIG. 6), which has been hydrated and heated in, for example, a microwave oven. Thus, the packet material is heated to, for example, over a hundred (100°) degrees F. just before it is to be used. Inside the layer of "ThermaFreeze"™ preferably is a second layer of bubble wrap (140) that slows the heat from the heated packet material from being conducted directly into the perishable food groceries. In this case, the bubble side of the bubble wrap (140) preferably is applied with the bubbles against the "ThermaFreeze"™ material.

Figure 8:
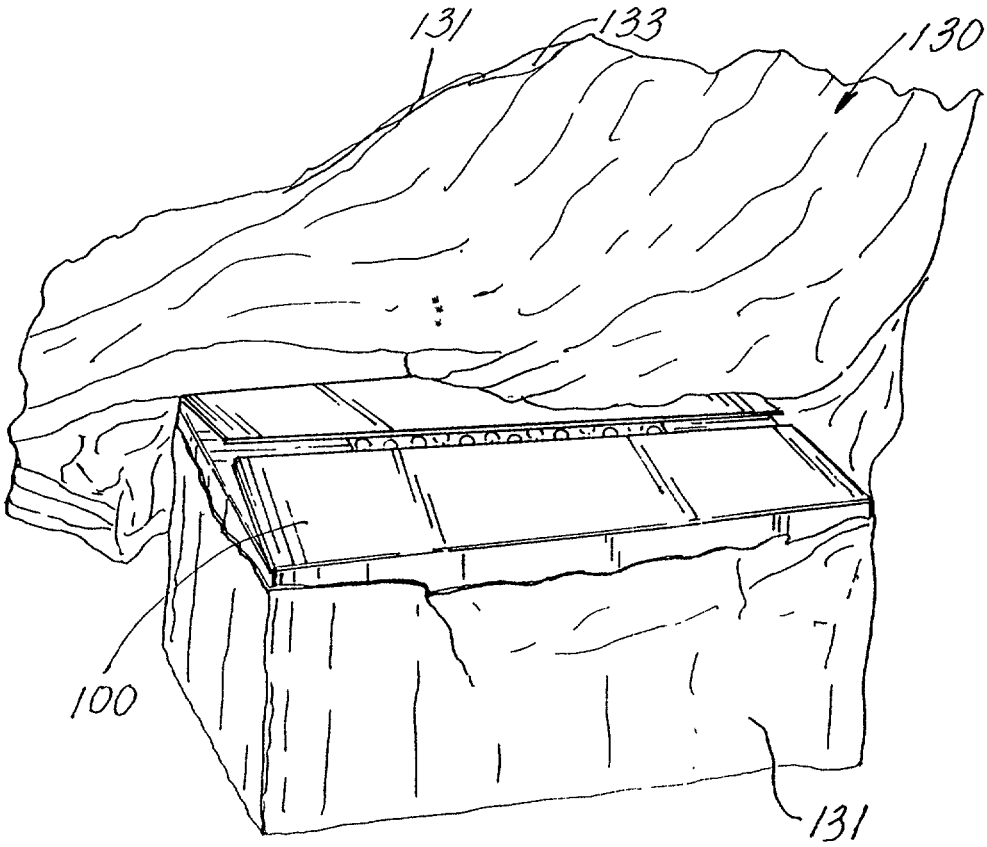
FIG. 8 is a top, perspective view of the elements of FIG. 7, but with the top flaps of the box folded over and with the packed box inserted into an outer, pouch, forming an outer cover, with the top of the pouch being pulled over the top of the box, as used in an exemplary, preferred embodiment of the packaging system of the present invention.

Once the box 100 is packed and sealed, preferably a black heavy gauge plastic film cover preferably made of polyethylene (comparable to cover 130 but without the metallized film layer 141) is used to cover the entire box 100, in similar fashion to that illustrated in FIGS. 8 & 9. The gage of the film will be similar to the metallized plastic film 141/142 described above. Like the metallized film cover 130 used for pure cooling applications, the black cover for the heating application preferably is constructed with a closing lip having a two-sided, tape sealing mechanism in like fashion to the tape 133. In addition to using the metallized film 141/142 packaging material for the cover (130), the 2 ply or 3 ply embodiments of the packaging material of FIGS. 23-25 could be used.

It is noted that, like the pure cooling applications, the heating application is subject to many variations in configurations and combinations.

Figure 1:
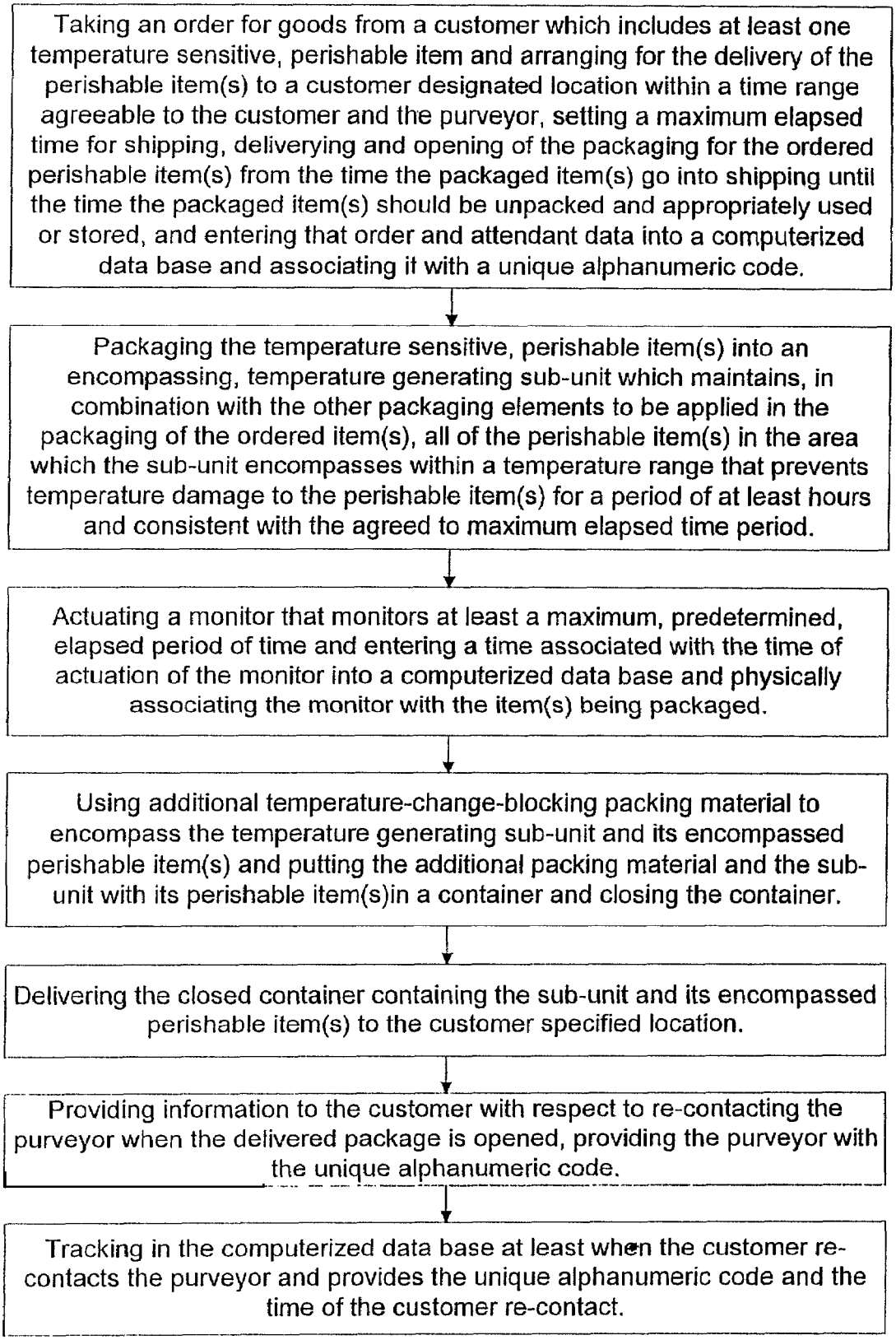
FIG. 1 is a flow chart summarizing an exemplary methodology and algorithms of a packaging and delivery system in which the preferred embodiments of the present invention can be used.

Exemplary Application Methodology Summary (FIG. 1)

As is summarized in FIG. 1, in the beginning (200) of the exemplary application's methodology for the invention's insulating, packaging material and packaging system, a customer places an order for groceries or other products with the purveyor typically using either a telephone call or a visit to an Internet site (201). If the order includes perishable items (202A), the customer preferably is informed of the special time of delivery arrangements (as agreeable with the customer) and calling arrangements that must be followed for the perishable groceries to be warranted by the purveyor to be in proper condition (203) when unpacked and placed in the customer's refrigerator/freezer. If there are no perishable items being ordered, the delivery arrangements follow the usual, temperature unprotective procedures (202B).

For perishable goods that are ordered, preferably the system's calculator analyzes the perishable goods in the order (204) and specifies for the purveyor's shipping department the proper packing procedure and protective elements to be used in packing the shipment for delivery (205). Based on the agreed to delivery time range and the availability of transportation, the ordered groceries are assembled for delivery (206), and the delivery department packages the ordered groceries in accordance with the calculator's instructions (207), unless over-ridden by appropriate supervisory personnel (208).

When the ordered groceries or other products have been appropriately packed in the appropriate temperature protective way, the time of completion is noted and entered in the purveyor's computerized data base system (210), the covered box 103/100 is sealed (211), inter alia the transaction tracking number is printed on the card 135 (212) and the card attached to the top of (or inside) the covered box (213). The elapsed time monitor 134A is activated to track at least the maximum allowed time for the box 100 to be opened and attached to the exterior (or interior) of the closed and sealed box. If both the maximum temperature and the maximum allowed elapsed time are to be monitored, as is preferred, either two different monitors can be used, with the elapsed time monitor 134 being attached to the exterior of the closed and sealed box 130/100 and the maximum-temperature-allowed monitor placed on top of the perishable goods (120/120'), or, alternatively and as preferred, a combined maximum temperature and maximum elapsed time monitor 135 could be used and placed with the perishable goods in the stage represented in FIG. 5 (209).

The sealed, covered box 130/100 is then turned over to the purveyor's transportation or delivery department (214) and the sealed, covered box is delivered to the customer's designated delivery location (215) and the time of delivery noted and entered into the purveyor's computerized data base (216). This data entry can be immediately entered preferably by, for example, wireless communication (217) or entered when the delivery truck returns to the purveyor's business location, assuming the time of return is consistent with the remaining preferred methodology.

The purveyor's computer tracks the elapsed time of package completion (i.e., the occurrence of step 210 or 211) and the time of delivery (namely, that determined in step 216), and, if the customer does not "call" in or otherwise the timely opening of the covered box 130/100 is not confirmed, the preferred system initiates a customer calling procedure, repetitively calling the customer, for example, every ten (10) minutes for an appropriate period of time (e.g., up to an hour) until contact and an appropriate response is made with respect to the time of opening (and presumed putting away of the perishable goods) of the delivered package.

The use of a tone generating, telephone key pad or an Internet site allows a completely automated data entry system from the purveyor's point of view for the customer's packing opening information.

The time of the determined opening of the box 100 is used to determine whether the perishable goods have been handled in a timely manner (217) and, if timely, the perishable goods are effectively warranted (218) and, if not, the warranty lapses (219). In the latter instance the customer, if he or she so desires (220), calls the purveyor and arranges for the pick-up of the now unwarranted, perishable item(s).

The data concerning this transaction is posted to the purveyor's computerized data base for further analysis and possible use in the "calculator" step (221), and the process is completed (222).

Of course, the foregoing exemplary application in which the preferred embodiments of the insulating packaging materials and the exemplary embodiments of the related packaging system of the present invention were used is just one application example. The invention's insulating packaging materials and the related packaging system could be used in many, many other, nearly unlimited packaging applications, with the insulating packaging material being usable by itself as a packaging material or used with many other elements beside those described in connection with the exemplary embodiments of the related packaging system of the present invention. Thus, it should be understood that the present invention is completely independent of the foregoing exemplary packaging and delivery application, although quite useful in the application.

Graph of Test Results (FIG. 10)

The graph of FIG. 10 details the combined test results of a series of five tests run over approximately a week in a hot summer month in a deep south town, in which the average, exterior surface temperature measured in Fahrenheit (F) of the covered box 130/100 in direct sunlight is graphed in the upper line against the average temperature (F) in the temperature protected interior of the covered box in the lower line, over an exemplary six (6) hour period, while additionally providing an analysis of the system's percent efficiency (shown in the background block elements) achieved with embodiments of the present invention. The packaging elements of the covered box 130/100 were substantively the same throughout the tests, except in Tests No. 1-4 no bubble wrap layer(s) or sheet(s) (140) was/were included between the interior of the box 100 and the six (6) sheets of "Therma-Freeze"™ material (10), which material effectively formed the pouch 110*a* shown in FIGS. 5 & 6, while in Test No. 5 a single sheet of bubble wrap (140) material was included on the bottom of the box 100, generally as shown in FIG. 4, but without the illustrated four (4) side sheets or top sheet of bubble wrap material. Another variant was that in Tests Nos. 1 & 2, the covered box 130/100 was sitting on a pallet, while in Test Nos. 3-5 the covered box was sitting directly on an exposed concrete surface.

As can be seen in the graph, the average surface temperature from direct sunlight ranged from 88.18 degrees F. to 102.18 degrees F., while the average temperature of the temperature protected interior ranged from 25.51 degrees F. to 18.76 degrees F. temperatures, well low enough (and then some) to evenly protect highly temperature sensitive food items such as, for example, frozen ice cream (120).

Figure 6:
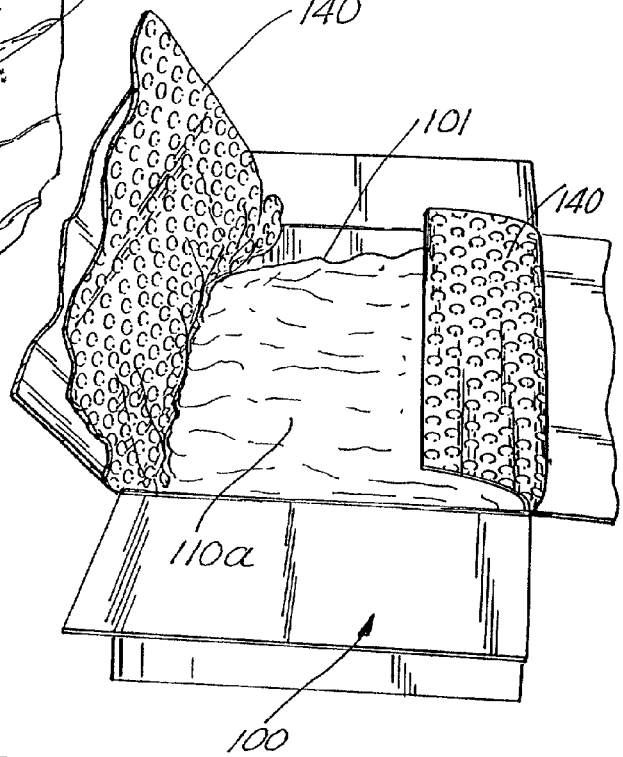
FIG. 6 is a top, perspective view of the elements of FIG. 5, but with the top of the all-encompassing pouch of hydrated, frozen packet material being folded over, topping off the contained grocery items and with part of the box interior's bubble wrap being partially folded over, as used in the exemplary, preferred embodiment of the packaging system of the present invention.
Figure 7:
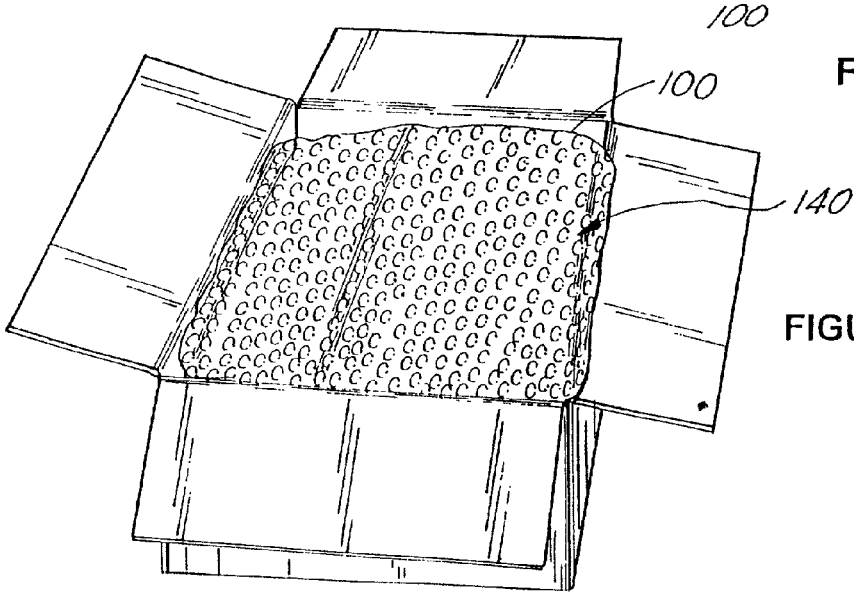
FIG. 7 is a top, perspective view of the elements of FIG. 6, but with the top of the box interior's bubble wrap being fully folded over, as used in the exemplary, preferred embodiment of the packaging system of the present invention.

Of course, with the additional sheets of bubble wrap (104), effectively forming an enclosing pouch 104 as shown in FIGS. 4, 6 & 7, as well as other variants and additions to the interior packing elements, the test results would be even better. Protective periods of eight (8) and fifteen (15) hours have been achieved and even longer times of protection are expected.

Other test results and related graphs are discussed below in connection with FIGS. 16-21.

Preferred "ThermaFreeze" Packet Sheet Material (FIGS. 11-15)

Figure 11:
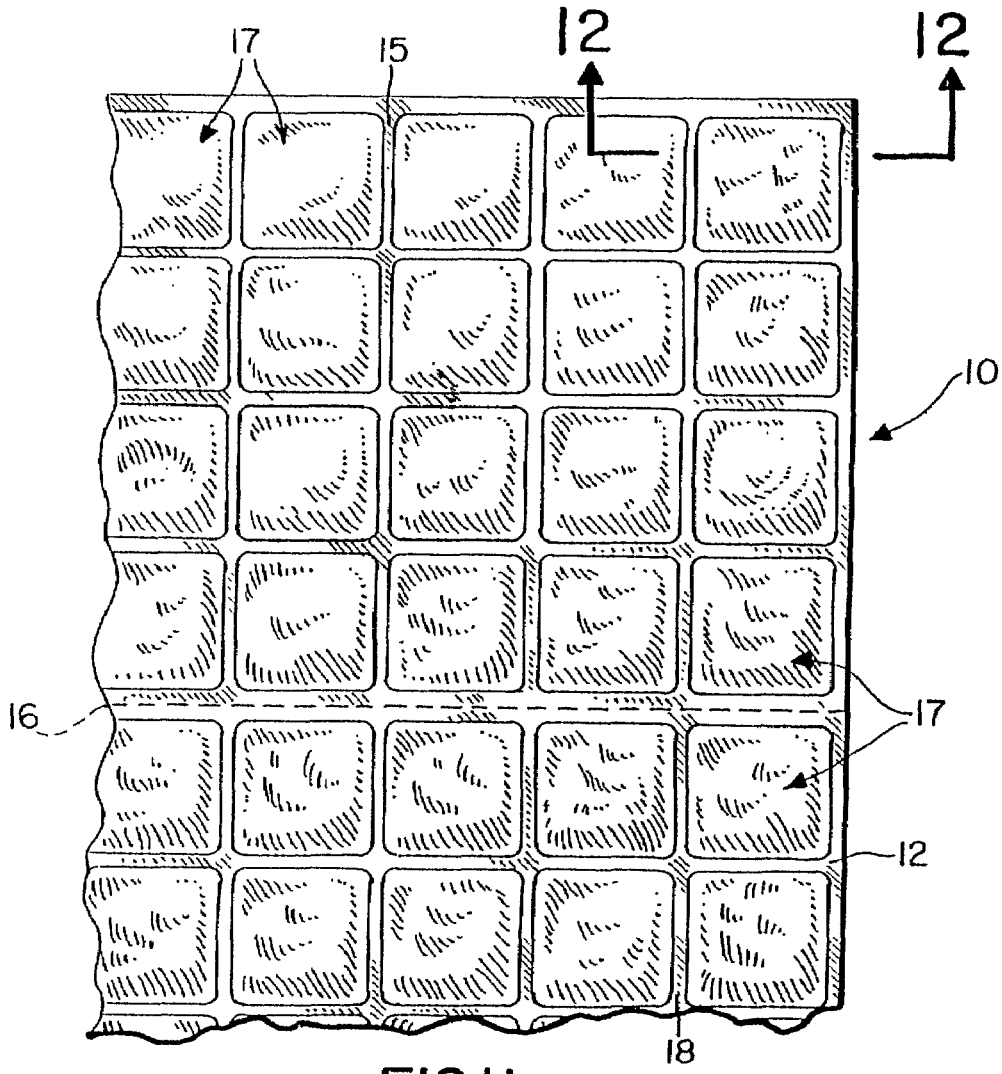
FIG. 11 is a plan view of the exemplary, preferred embodiment of the finished hydratable packet pad or sheet preferably used in the preferred methodology of the present invention.
Figure 12:
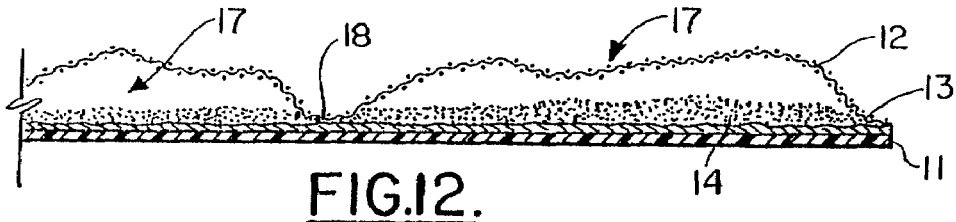
Figure 13:
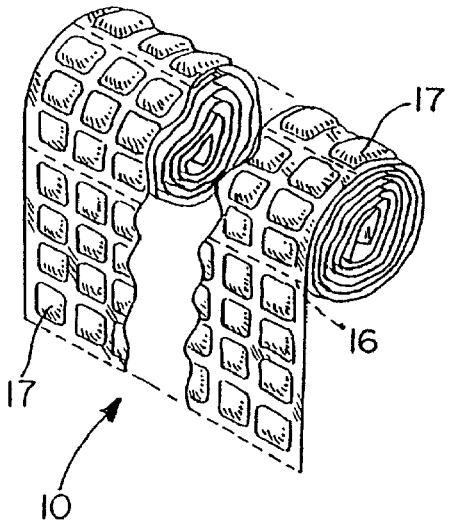
FIG. 13 is a perspective view of the packet sheet of FIG. 11 in roll form as provided, for example, to the end industrial user, e.g. the perishable groceries purveyor.

As can be seen in FIGS. 11-13, the preferred, exemplary embodiment of the hydratable sheet packet material 110 of the present invention comprises an extended sheet 10 of packets made up of a backing sheet 11, preferably of an impervious plastic sheet material (such as, for example, polyester film), and an upper, porous sheet 12 (such as, for example, non-woven polypropylene with no additives), with a preferably tacky, sealant or adhesive layer 13 [e.g. 22.5% ethylene-methyl-acrylate (EMA)], about one mil (0.0001") thick or up to about three mills (0.0003") thick (or equivalently 14.4 lbs. per ream of the finished sheet material), if one mil, used to affix and seal the two sheets 11 & 12 together along longitudinally and laterally extending lines 15 & 16, respectively, defining a series of cells 17 with the cells effectively joined by the flat areas 18 between adjacent cells.

Figure 12A:
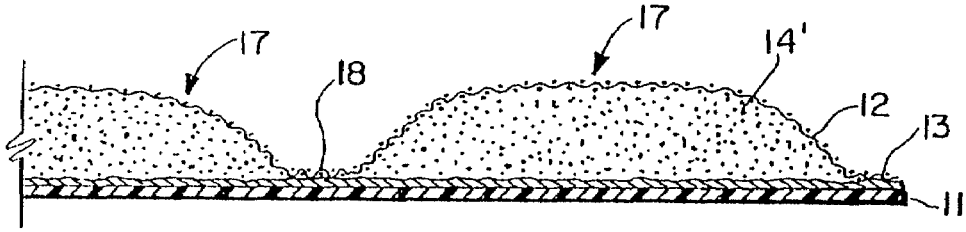
FIG. 12A is similar to FIG. 12 but with the packet sheet having been hydrated, with the super-absorbent polymer having super-absorbed the water and having been frozen ready for end use, it being noted that these figures are not construction or "to-scale" drawings but rather generalized ones, as is typical of patent application drawings.

Contained within each cell 17 of the packet sheet 10 is an appropriate amount of super-absorbent, polymer 14. As can be seen in FIG. 12, the polymer powder 14 initially occupies only a small amount [perhaps about fifteen (15%) percent] of the total interior volume of the cell 17. This allows room for the approximately ten (10) fold expansion which occurs as the polymer 14 is hydrated by being soaked in water, which the polymer absorbs, and the hydrated polymer is ultimately frozen. As shown in FIG. 12A, in this hydrated state, the hydrated polymer 14 expands and fills out the interior of the cell 17.

Additionally, when the polymer powder 14 is initially deposited on the film sheet 11 with its tacky adhesive layer 13, it is deposited in the area destined to be made into a cell (17) basically in the form of a circular cone, preferably with a relative wide base in comparison to its height, for example, in a circular cone having a base with a diameter of three-quarters of an inch (¾") and a height of a quarter (¼") inch, with these preferred dimensions having a ratio of three-to-one (3:1). For enhanced polymer pile stability, it is believed that the minimum ratio should be at least about two-to-one (2:1).

This provides a relatively stable, conglomerated pile, with a substantial amount of the powder 14 in contact with the tacky adhesive layer, substantially stabilizing to some degree all of the polymer powder on the film 11. As a result, the entire pile is much more stable, resulting in little or no loss of powder outside of the cell area 17 as the film 13 with the polymer powder 14 on it moves to the heat/pressure sealing rollers.

The polymer 14 preferably is multiply-cross-linked and preferably contains no alcohol, such as, for example, double-cross-linked sodium polyacrylate polymer, such as that of Stockhausen, Inc.'s "AP88" super-absorbent polymer, preferably in powder or particulate form.

"AP88" is a double-cross-linked, sodium polyacrylate that contains no alcohol component and more particularly no poly-alcohols. Stockhausen, Inc. is located at 2401 Doyle St., Greensboro, N.C. 27406. In contrast, the absorbent material used in the 1994, prior art packet cell was Stockhausen's "FAVOR® SAB 800," a super-absorbent polymer with a chemical basis of a salt of cross-linked polyacrylic acid/polyalcohol grafted copolymer, which material in only singly cross-linked and contains polyalcohol with a number of alcohol (OH) functional groups.

The use of a double-cross-linked or higher (2+) cross-linked polymer for the super-absorbent material 14 provides a much more effective product which is able to contain fluids, such as the product's hydration water. Additionally, the use of a super-absorbent polymer which does not contain any alcohol functional groups, particularly any polyalcohols, provides for a more stable, safer product due in part to the absence of the volatility and combustibility such polyalcohol polymers typically have. As a result of the double-cross-linking of the super-absorbent material 14, the packet cells contain and hold the hydration water longer, slowing the thawing process, producing the greater than eight-to-one (>8:1) advantage the preferred embodiment of the invention has over the 1994 product and is highly pressure resistant.

It is noted that the embodiment of the packet sheet material 10 described in detail for exemplary purposes is of course subject to many different variations in structure, design, application and methodology. For further examples, the adhesive layer could be added only where the polymer powder is to be placed and not in the sealed, cell surrounding areas 18, although it is currently preferred to have the adhesive layer cover the entire surface of the backing film, as described above. Likewise, water permeable material could be used for both sheets of material (11 & 12), if so desired, or the water permeable material could be used only in the areas where the super-absorbent polymer is located or only in part(s) thereof, although again the embodiment described in detail above is currently preferred. Also, the adhesive layer could be put on both sheets of material or only the permeable one, but again the embodiment illustrated and described in detail in connection with FIGS. 11-13 is currently preferred.

Additional details on this preferred temperature affecting source 10 (either coldness or heat) is provided in co-pending patent application Ser. No. 09/079,872, referred to above (issued as U.S. Pat. No. 6,269,654).

Further, Exemplary Test Data Using Packaging System (FIGS. 16-21)

To test the effectiveness of the exemplary embodiments of the packaging materials and packaging system of the present invention, a series of tests were run using various, exemplary perishable products of the food and pharmaceutical type. These tests will be described below with references to the graphs of FIGS. 16-21.

Figure 16:
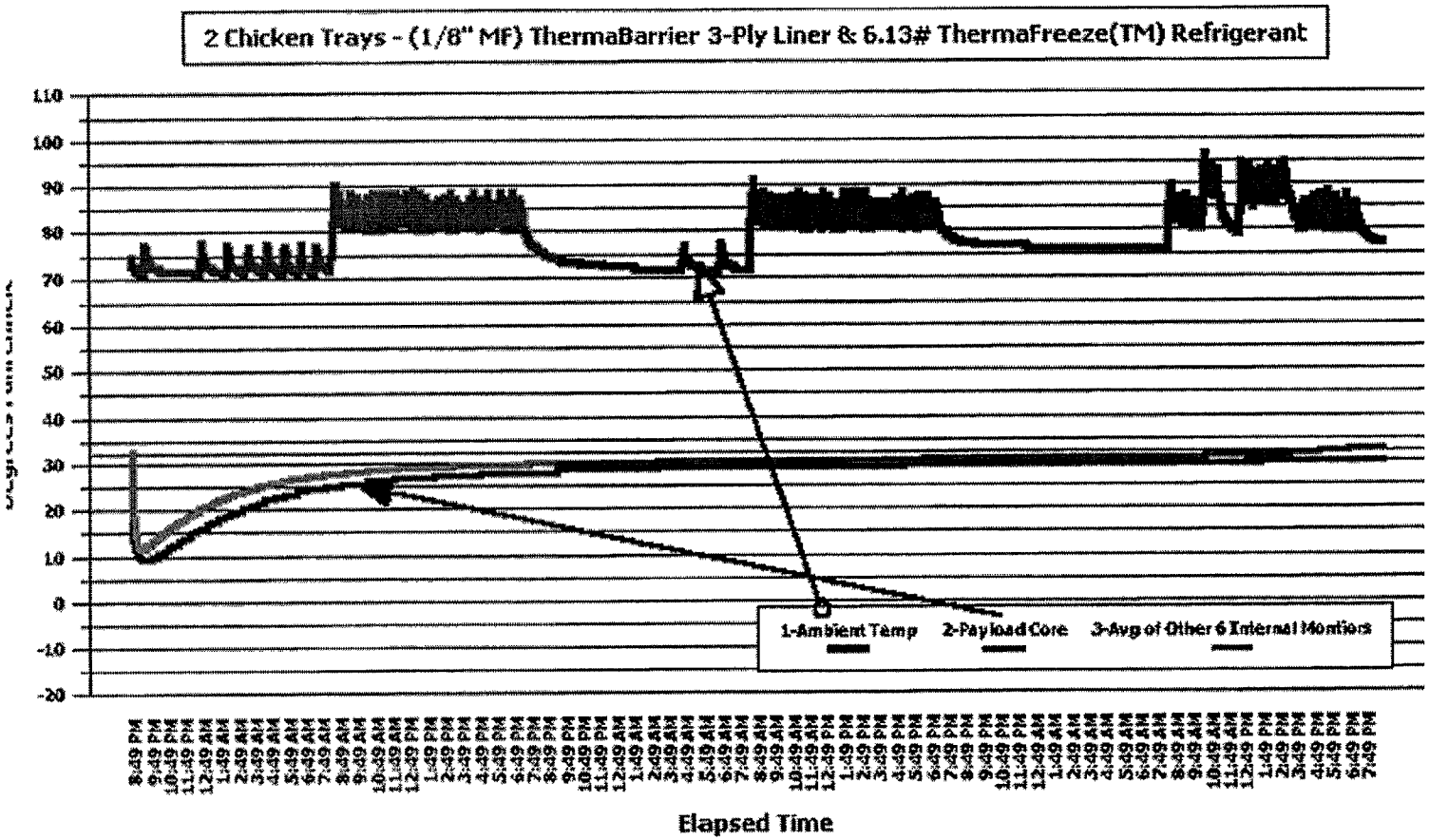
FIGS. 16-21 are temperature vs. time graphs summarizing test data from a series of tests run on various types of products using exemplary embodiments of the insulating packaging material and related packs of the present invention.

With reference to FIG. 16, the purpose of this test was to keep two large trays of chicken parts frozen for a period of seventy-two (72 hrs.) hours. The test included an EPS ("Styrofoam") cooler, two trays of chicken parts, a ThermaBarrier™ 3-ply liner and six and thirteen-hundredths (6.13#) pounds of ThermaFreeze™ refrigerant. The test was conducted in a sealed laboratory chamber with a computer controlled thermostat to emulate temperature changes between daylight and nighttime hours across the test period.

The ThermaBarrier™ was used as a liner for the cooler. The chicken and ThermaFreeze™ refrigerant were sealed within the liner. The ThermaBarrier™ liner acted as a "supercharger" to substantially improve the thermal protection capability of the EPS cooler and permit longer transit times, as described below:

1. The outer ply of bubble wrap provides initial protection against conducted heat energy. Laminating bubble wrap to the foil (or metal) layer with the bubbles against the substrate, as is described in this art, is more difficult to manufacture than lamination with the flat side against the substrate. However, the art described in this application doubles the volume of trapped air available to act as a barrier to conducted heat since the air between the bubbles is trapped in the lamination.

If the bubble wrap is conversely laminated with the flat side to the substrate, the only protection against conducted heat is at each bubble containing trapped air. In that type of configuration, each bubble is surrounded by a heat leak zone around the circumference of each bubble.

2. The foil (metal) ply serves two purposes:
   It acts as a protection against most of the radiant energy (i.e. UV rays from sunlight) that may get through the outer packaging since the foil (metal) ply has an emissivity rating of ninety-eight (98) and no less than ninety-four (94) with bubble wrap laminated to the outer surface.
   The foil (metal) ply provides a relatively impermeable barrier to the rapid escape of cold from the refrigerant contained within the liner as a temperature control medium. In that sense the foil (metal) layer of the ThermaBarrier™ 3-ply liner acts to form a barrier that contains cold for a longer period of time.
3. The flexible foam ply is a dense, closed cell material (preferably polypropylene; preferably similar to Microfoam® produced by Pactiv, Inc.) that provides an additional barrier against conducted heat energy that works its way through the first two plies. In the early stages of a two to three day shipment, the foam also tends to work with the foil (metal) ply to contain cold temperatures inside the payload zone of the package.

All of these technical properties and advantages work together to permit an extension of controlled frozen or cold transit time from two to three (3) full days in ambient temperature conditions that steadily attacked the test package with high ambient temperatures during daylight hours.

Temperature monitors were placed inside the ThermaBarrier™ liner at seven locations, top, bottom, front, rear, left side, right side and at the core of the chicken payload. An eighth temperature monitor was placed to monitor the box top ambient temperature attacking the test package.

As is seen in FIG. 16, the core temperature of the chicken payload did not rise above thirty (30°) degrees F. and the surrounding temperature did not reach thirty-two (32°) degrees F. until the final moments of the seventy-two (72 hr.) hour test.

Figure 17:
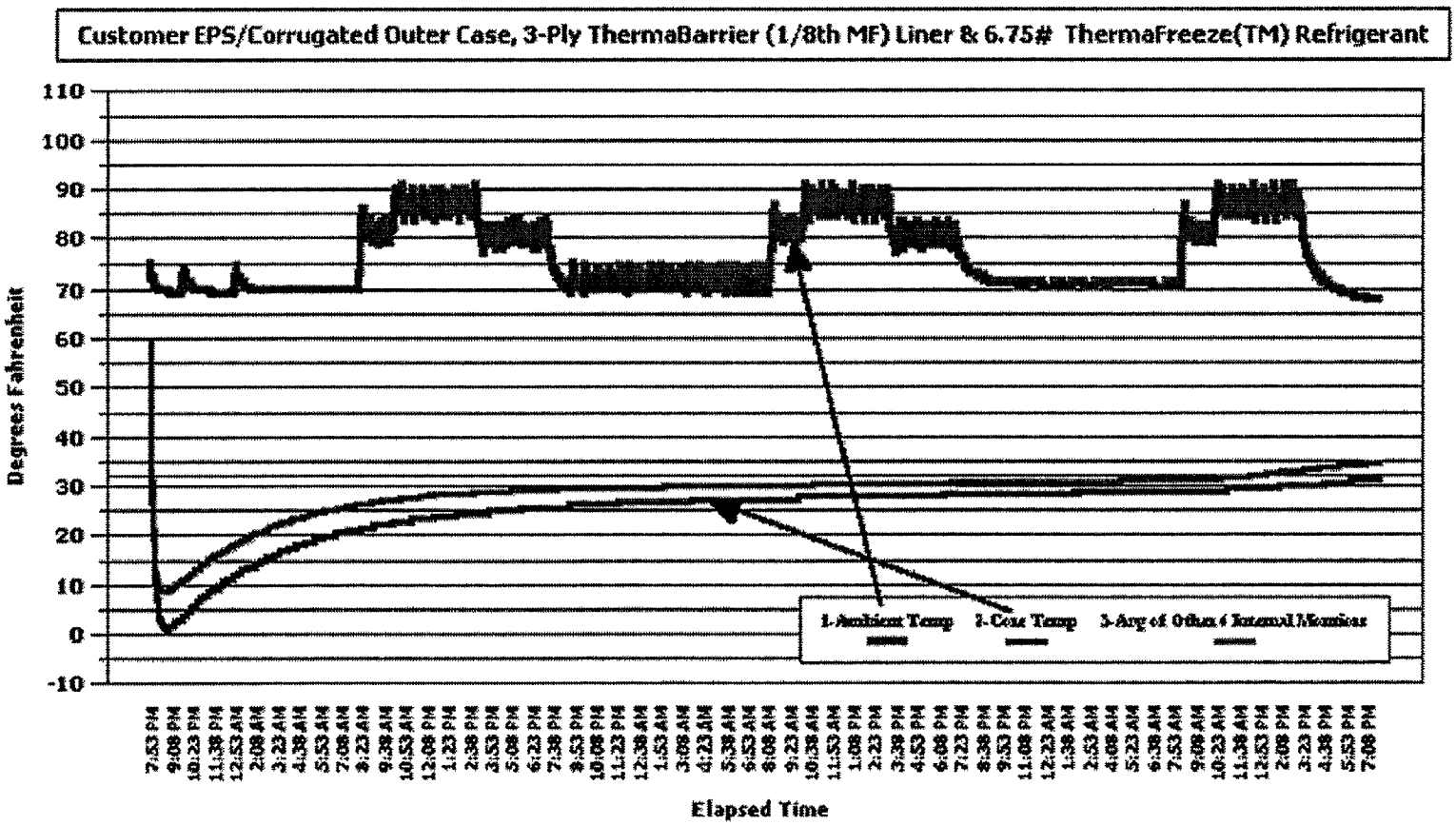

With reference to FIG. 17, the purpose of this test was to keep a case of packaged meals frozen for a period of seventy-two (72 hrs.) hours. The test included an EPS (Styrofoam) cooler, a case of packaged meals, a ThermaBarrier™ 3-ply liner and six and three-quarters (6.75#) pounds of ThermaFreeze™ refrigerant. The test was conducted in a sealed laboratory chamber with a computer controlled thermostat to emulate temperature changes between daylight and nighttime hours across the test period.

The ThermaBarrier™ insulating, packaging material was used as a liner for the cooler. The meals and ThermaFreeze™ refrigerant were sealed within the liner. The ThermaBarrier™ liner acted as a "supercharger" to substantially improve the thermal protection capability of the EPS cooler and permit longer transit times, as described below:

1. The outer ply of bubble wrap provides initial protection against conducted heat energy. Laminating bubble wrap to the foil (or metal) layer with the bubbles against the substrate, as is described in this art, is more difficult to manufacture than lamination with the flat side against the substrate. However, the art described in this application doubles the volume of trapped air available to act as a barrier to conducted heat since the air between the bubbles is trapped in the lamination.

If the bubble wrap is conversely laminated with the flat side to the substrate, the only protection against conducted heat is at each bubble containing trapped air. In that type of configuration, each bubble is surrounded by a heat leak zone around the circumference of each bubble.

2. The foil (metal) ply serves two purposes:
   It acts as a protection against most of the radiant energy (i.e. UV rays from sunlight) that may get through the outer packaging since the foil (metal) ply has an emissivity rating of ninety-eight (98) and no less than ninety-four (94) with bubble wrap laminated to the outer surface.
   The foil (metal) ply provides a relatively impermeable barrier to the rapid escape of cold from the refrigerant contained within the liner as a temperature control medium. In that sense the foil (metal) layer of the ThermaBarrier™ 3-ply liner acts to form a barrier that contains cold for a longer period of time.
3. The flexible foam ply is a dense, closed cell material (preferably polypropylene; preferably similar to Microfoam® produced by Pactiv, Inc.) that provides an additional barrier against conducted heat energy that works its way through the first two plies. In the early stages of a two to three day shipment, the foam also tends to work with the foil (metal) ply to contain cold temperatures inside the payload zone of the package.

All of these technical properties and advantages work together to permit an extension of frozen transit time from two to three full days in ambient temperature conditions that steadily attacked the test package with high ambient temperatures during daylight hours.

Temperature monitors were placed inside the ThermaBarrier™ liner at seven locations, top, bottom, front, rear, left side, right side and at the core of the packaged meal payload. An eighth monitor was placed to measure the box top ambient temperature attacking the test package.

As is seen in FIG. 17, the core temperature of the payload did not rise above thirty-two (32°) degrees F. and the surrounding temperature did not breach thirty-two (32°) degrees F. until the final moments of the seventy-two (72)-hour test.

Figure 18:
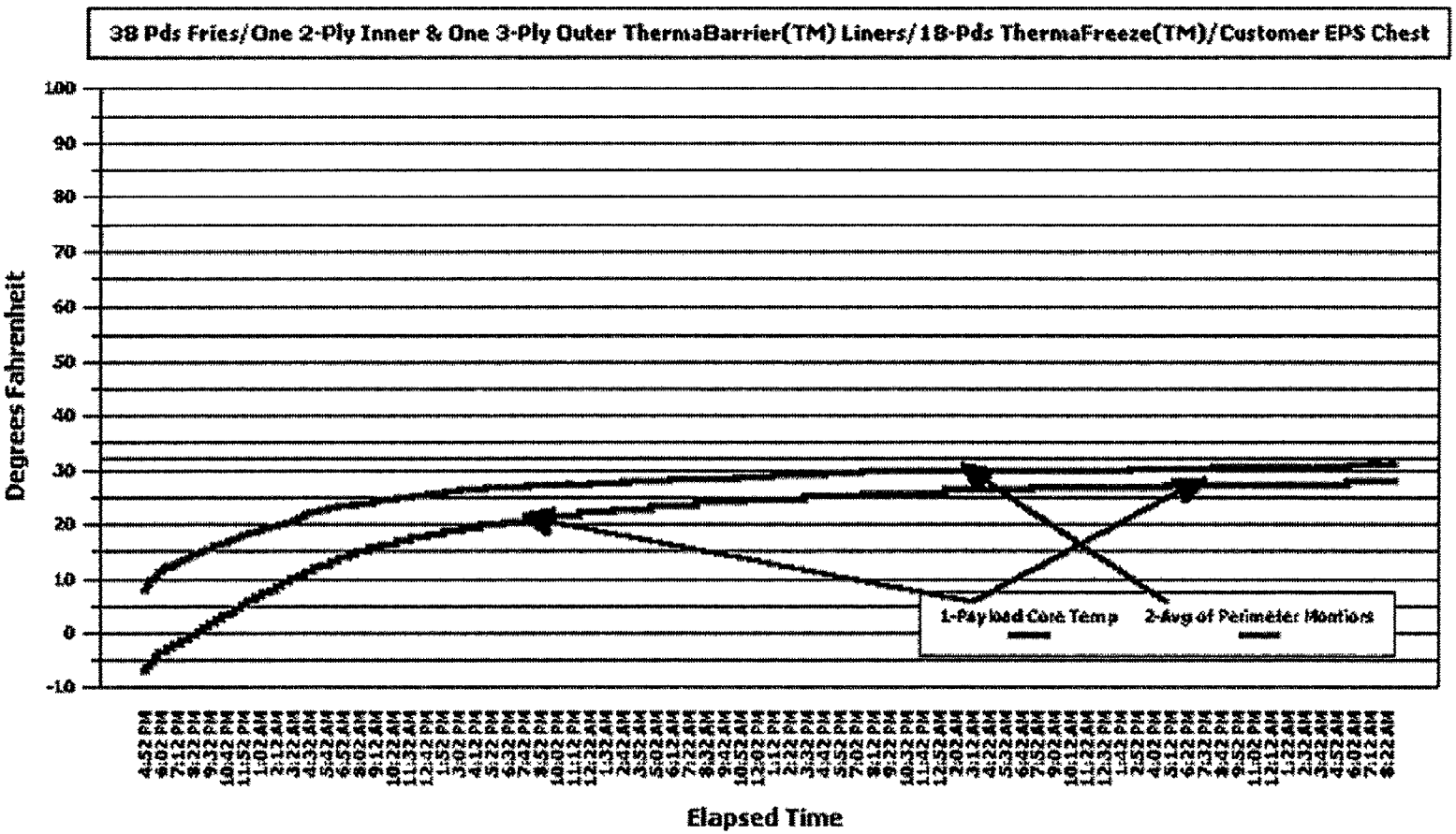

With reference to FIG. 18, the purpose of this test was to keep a case of French fries [thirty-eight (38#) pounds] frozen during a ground transit from Mobile, Ala. to Jamestown, N.D. The test included a low-density, one (1") inch EPS ("Styrofoam") cooler, a case of French fries, a ThermaBarrier™ 3-ply liner, a ThermaBarrier™ 2-ply liner and eighteen (18#) pounds of ThermaFreeze™ refrigerant. The test shipment was shipped via UPS ground service.

The fries and nine (9#) pounds of ThermaFreeze™ refrigerant were encased in a ThermaBarrier™ 2-ply cover comprising one ply metallized plastic film with bubble wrap laminated to the outer surface with the bubbles against the substrate.

A 3-ply ThermaBarrier™ liner was used to line the cooler. The remaining ThermaFreeze™ refrigerant was placed between the two liners. The inner ThermaBarrier™ liner acted as a mini-refrigerator, containing the cold and holding conducted heat away from the payload for an extended period of time. The outer ThermaBarrier™ liner acted as a "supercharger" to substantially improve the thermal protection capability of the package structure, permitting longer transit times, as described below:

1. The outer ply of bubble wrap provides initial protection against conducted heat energy. Laminating bubble wrap to the foil (or metal) layer with the bubbles against the substrate, as is described in this art, is more difficult to manufacture than lamination with the flat side against the substrate. However, the art described in this application doubles the volume of trapped air available to act as a barrier to conducted heat since the air between the bubbles is trapped in the lamination.

If the bubble wrap is conversely laminated with the flat side to the substrate, the only protection against conducted heat is at each bubble containing trapped air. In that type of configuration, each bubble is surrounded by a heat leak zone around the circumference of each bubble.

2. The foil (metal) ply serves two purposes:
   - It acts as a protection against most of the radiant energy (i.e. UV rays from sunlight) that may get through the outer packaging since the foil (metal) ply has an emissivity rating of 98 and no less than 94 with bubble wrap laminated to the outer surface.
   - The foil (metal) ply provides a relatively impermeable barrier to the rapid escape of cold from the refrigerant contained within the liner as a temperature control medium. In that sense the foil (metal) layer of the ThermaBarrier™ 3-ply liner acts to form a barrier that contains cold for a longer period of time.
3. The flexible foam ply is a dense, closed cell material (preferably polypropylene; preferably similar to Microfoam® produced by Pactiv, Incorporated) that provides an additional barrier against conducted heat energy that works its way through the first two plies. In the early stages of a two to three day shipment, the foam also tends to work with the foil (metal) ply to contain cold temperatures inside the payload zone of the package.

All of these technical properties and advantages work together to permit an extension of frozen transit time for extended times in high ambient temperature conditions on long haul trucks and during "break bulk" layovers.

Temperature monitors were placed between the EPS (Styrofoam) cooler and the 3-ply ThermaBarrier™ liner at seven locations, top, bottom, front, rear, left side, right side and at the core of the French fry payload. The nature of the package prevented placement of a monitor to measure ambient temperature during transit, however, it is a matter of record that UPS, and other package delivery trucks, reach or closely approach 100° F. in the interior of the truck beginning in the spring of the year.

As seen in FIG. 18, the core temperature of the payload did not exceed 28° F. and the perimeter temperatures did not breach thirty-two (32°) degrees F. across the eighty-eight (88 hr.)-hour (3-days, 16-hours & 5-minutes) test.

Figure 19:
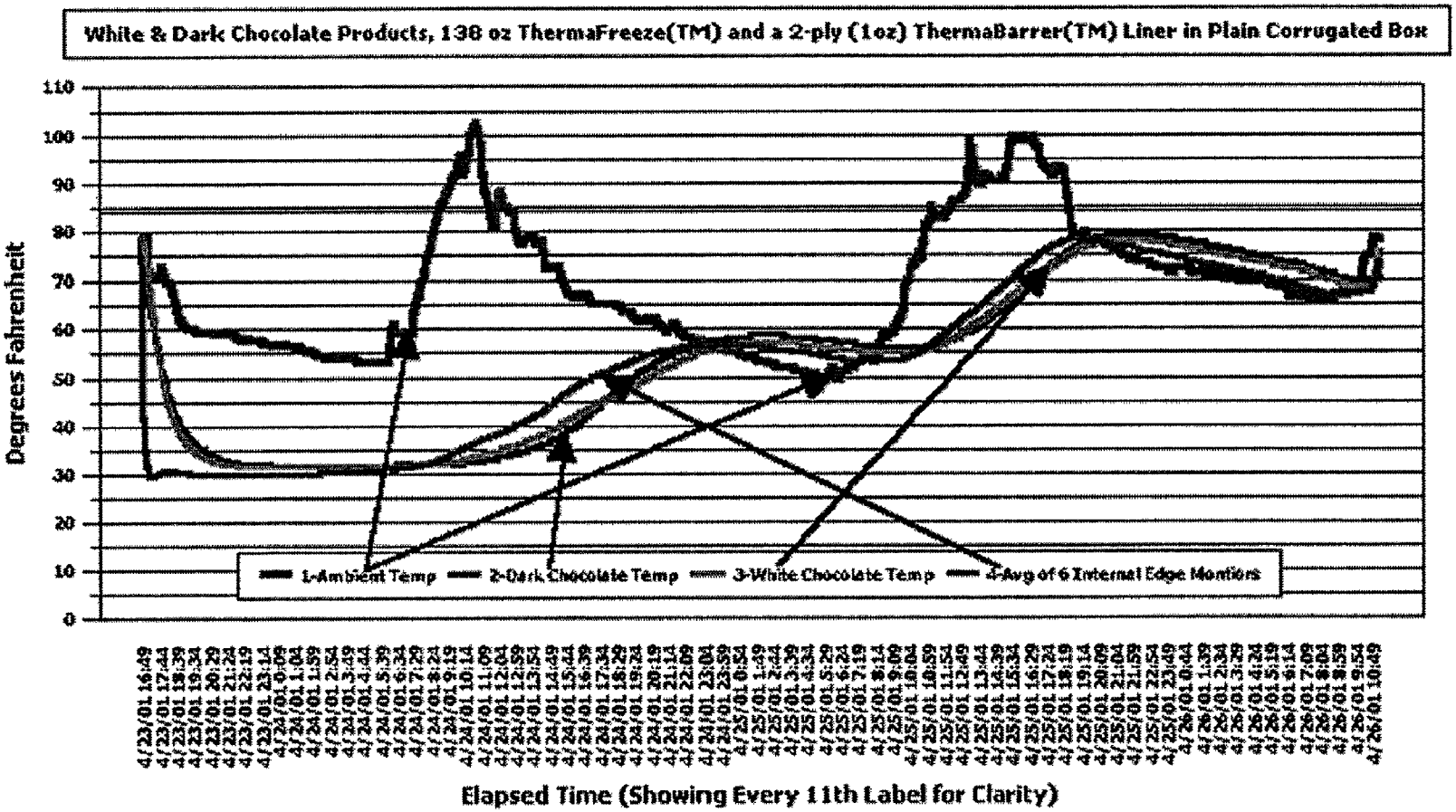

With reference to FIG. 19, the purpose of this test was to keep packaged white and dark chocolate products below 84° F. during a 3-day transit from Mobile, Ala. to Sioux City, Iowa. The melt point for the chocolate used is 86° F. for the dark and 90° F. for the white chocolates. The chocolates were shipped in a plain corrugated box with only a ThermaBarrier™ 2-ply liner and 8.6 pounds of ThermaFreeze™ refrigerant for protection. The test was shipped by FedEx ground service.

The 2-ply ThermaBarrier™ liner used consisted of flexible foam with bubble wrap laminated to the outer surface with the bubbles facing the substrate. The chocolate products and ThermaFreeze™ refrigerant were sealed within the liner.

1. The outer ply of bubble wrap provides initial protection against conducted heat energy. Laminating bubble wrap to the foam layer with the bubbles against the substrate, as is described in this art, is more difficult to manufacture than lamination with the flat side against the substrate. However, the art described in this application doubles the volume of trapped air available to act as a barrier to conducted heat since the air between the bubbles is trapped in the lamination.

If the bubble wrap is conversely laminated with the flat side to the substrate, the only protection against conducted heat is at each bubble containing trapped air. In that type of configuration, each bubble is surrounded by a heat leak zone around the circumference of each bubble.

2. The flexible foam ply is a dense, closed cell material (preferably polypropylene; preferably similar to Microfoam® produced by Pactiv, Incorporated) that provides an additional barrier against conducted heat energy that works its way through the first ply. In the early stages of a two to three day shipment, the foam also tends to work with the bubble wrap ply to contain cold temperatures inside the payload zone of the package.

These technical properties and advantages work together to permit an extension of controlled frozen or cold transit time from two to three full days in ambient temperature conditions that steadily attacked the test package with high ambient temperatures during daylight hours.

Temperature monitors were placed inside the ThermaBarrier™ liner at seven locations, top, bottom, front, rear, left side, right side and at the core of the chocolates payload. An eighth temperature monitor was placed to monitor the box top ambient temperature attacking the test package.

As is seen in FIG. 19, the core temperature of the payload and the perimeter temperatures did not raise above eighty (80°) degrees F. at any point during the sixty-six (66 hr.) hour transit time from Mobile, Ala. to Sioux City, Iowa.

Figure 20:
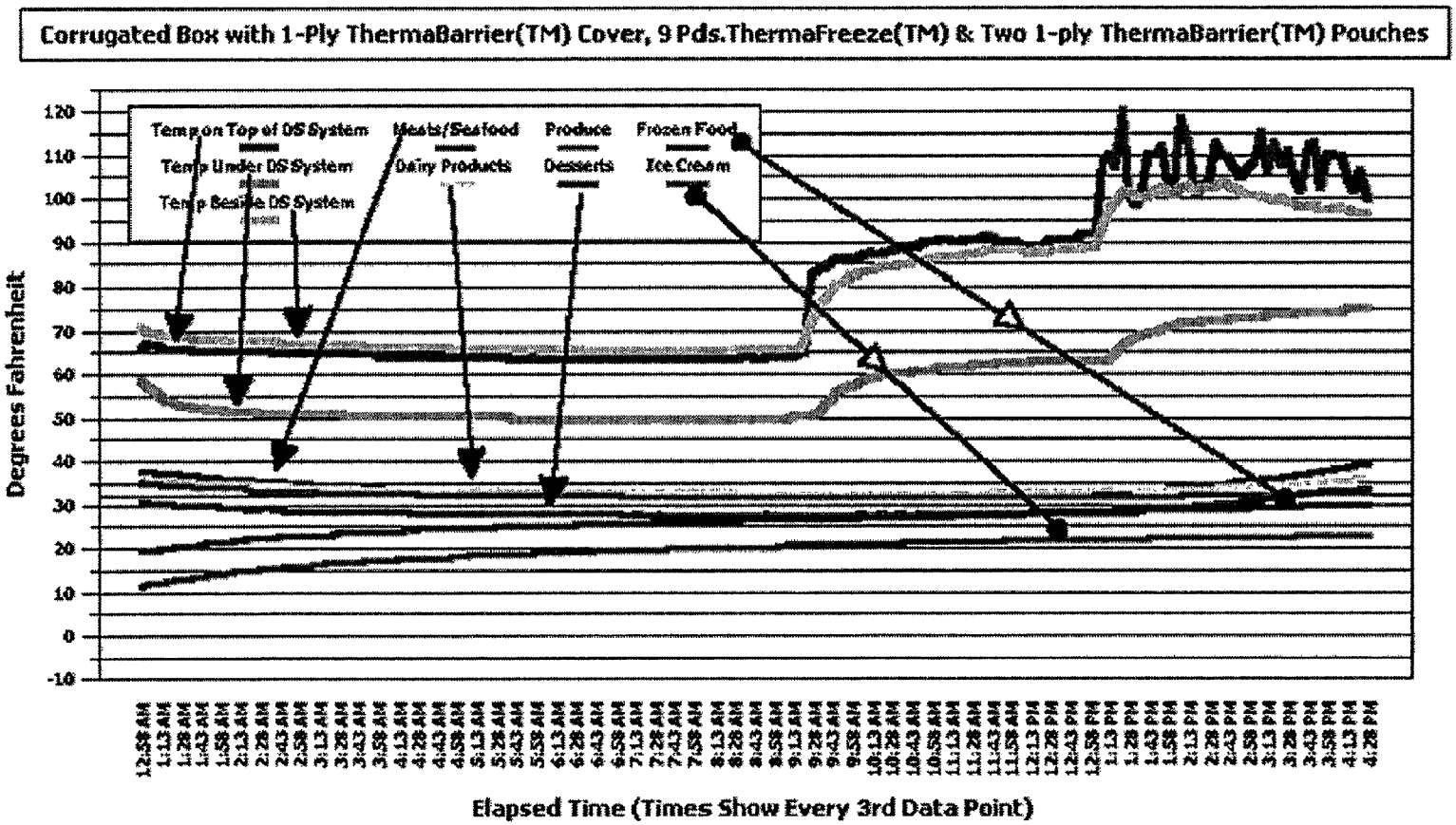

With reference to FIG. 20, the purpose of this test was to keep refrigerated and frozen groceries within designated temperature ranges in the same delivery container for fifteen (15) hours. The object was to emulate standard delivery conditions in a major supermarket facility. The products tested were:

Meats & Seafood: fresh chicken parts, fresh flounder, bacon, packaged lunch meat;

Dairy Products: milk, cheese, eggs;

Produce: celery, carrots;

Desserts: Chocolate Pudding, Yogurt;

Frozen Foods: TV Dinner, Stuffed Sandwiches; and

Ice Cream: Two pints of high fat content ice cream.

The container was a plain corrugated box. Common bubble wrap was used to line the box, with the bubbles facing the box walls to double the volume of trapped air (although either 2-ply or 3-ply ThermaBarrier™ liners could be used to extend the temperature-controlled delivery time).

The fresh chicken parts and fresh flounder were packaged in a 1-ply ThermaBarrier™ pouch with a small pad of ThermaFreeze™ refrigerant for additional protection. The two pints of ice cream were packaged in separate 3-ply ThermaBarrier™ pouches with additional ThermaFreeze™ refrigerant for additional protection (ice cream is the most difficult food product to ship outside a refrigerated truck since it "phase changes" (wants to become a liquid again) at twenty-three (23°) degrees F.

The balance of the simulated grocery order was packed into the payload zone of the box without traditional protection. ThermaFreeze™ refrigerant was deployed around the sides, top and bottom of the payload zone, inside the bubble wrap lining as an additional box liner. The final packaging element was to cover the entire shipment with a 1-ply ThermaBarrier™ cover to act as a protection against radiant energy (i.e. UV rays from sunlight) and as a waterproof cover in the event of rain.

The purpose of the test scenario was to emulate the groceries being picked and packaged late at night in a supermarket facility and kept overnight in a cool room maintained at temperatures between sixty-five and seventy-three (65-73°) degrees F. At a point after 9:00 AM the scenario called for an emulation of the shipment being placed on a delivery vehicle with ambient temperatures ranging from eighty-five to a hundred (85-100°) degrees F. during a simulated 4-hour delivery route. The final emulation for the shipment was being placed on a doorstep in direct sunlight for at least three (3 hrs.) hours with ambient temperatures ranging from one hundred to one hundred and twenty (100-120°) degrees F.

The ThermaBarrier™ configurations used proved highly effective at protecting the shipment from heat across the entire fifteen and a half (15.5 hr.) hour test period. In this test, 1-, 2- and 3-ply ThermaBarrier™ configurations were employed to protect the test media.

1. The outer ply of bubble wrap inside the box provides initial protection against conducted heat energy. Laminating bubble wrap to the foil (or metal) layer with the bubbles against the substrate, as is described in this art, is more difficult to manufacture than lamination with the flat side against the substrate. However, the art described in this application doubles the volume of trapped air available to act as a barrier to conducted heat since the air between the bubbles is trapped in the lamination.

If the bubble wrap is conversely laminated with the flat side to the substrate, the only protection against conducted heat is at each bubble containing trapped air. In that type of configuration, each bubble is surrounded by a heat leak zone around the circumference of each bubble.

2. The foil (metal) ply serves two purposes:

It acts as a protection against most of the radiant energy (i.e. UV rays from sunlight) that may strike the outer cover or get through the outer packaging since the foil (metal) ply has an emissivity rating of ninety-eight (98) and no less than about ninety-four (94) with bubble wrap laminated to the outer surface.

The foil (metal) ply provides a relatively impermeable barrier to the rapid escape of cold from the refrigerant contained within the liner as a temperature control medium. In that sense the foil (metal) layer of the ThermaBarrier™ 3-ply liner acts to form a barrier that contains cold for a longer period of time.

3. The flexible foam ply is a dense, closed cell material (preferably polypropylene; preferably similar to Microfoam® produced by Pactiv, Incorporated) that provides an additional barrier against conducted heat energy that works its way through the first two plies. In the early stages of a two to three day shipment, the foam also tends to work with the foil (metal) ply to contain cold temperatures inside the payload zone of the package.

All of these technical properties and advantages worked separately and together to permit an extension of frozen transit time from food storage facilities to final delivery in brutal temperature conditions with the foods fully protected.

Temperature monitors were placed inside each food product tested to determine the actual food temperatures across the test period. Ambient temperature was tested on top of the shipment, under the shipment and directly beside the shipment. The latter was employed to assess the amount of heat radiated from the heated surface the shipment was placed on against the side of the shipment box.

As is seen in FIG. 20, the core temperatures of the various payloads stayed in the appropriate temperature ranges. All of the refrigerated goods stayed at a cold refrigerator temperature, just above thirty-two (32°) degrees F. The frozen foods and ice cream stayed within the precise temperature ranges specified for them with the ice cream, in particular, finishing the test at twenty-three (23°) degrees F. which is its phase change limit.

Figure 21:
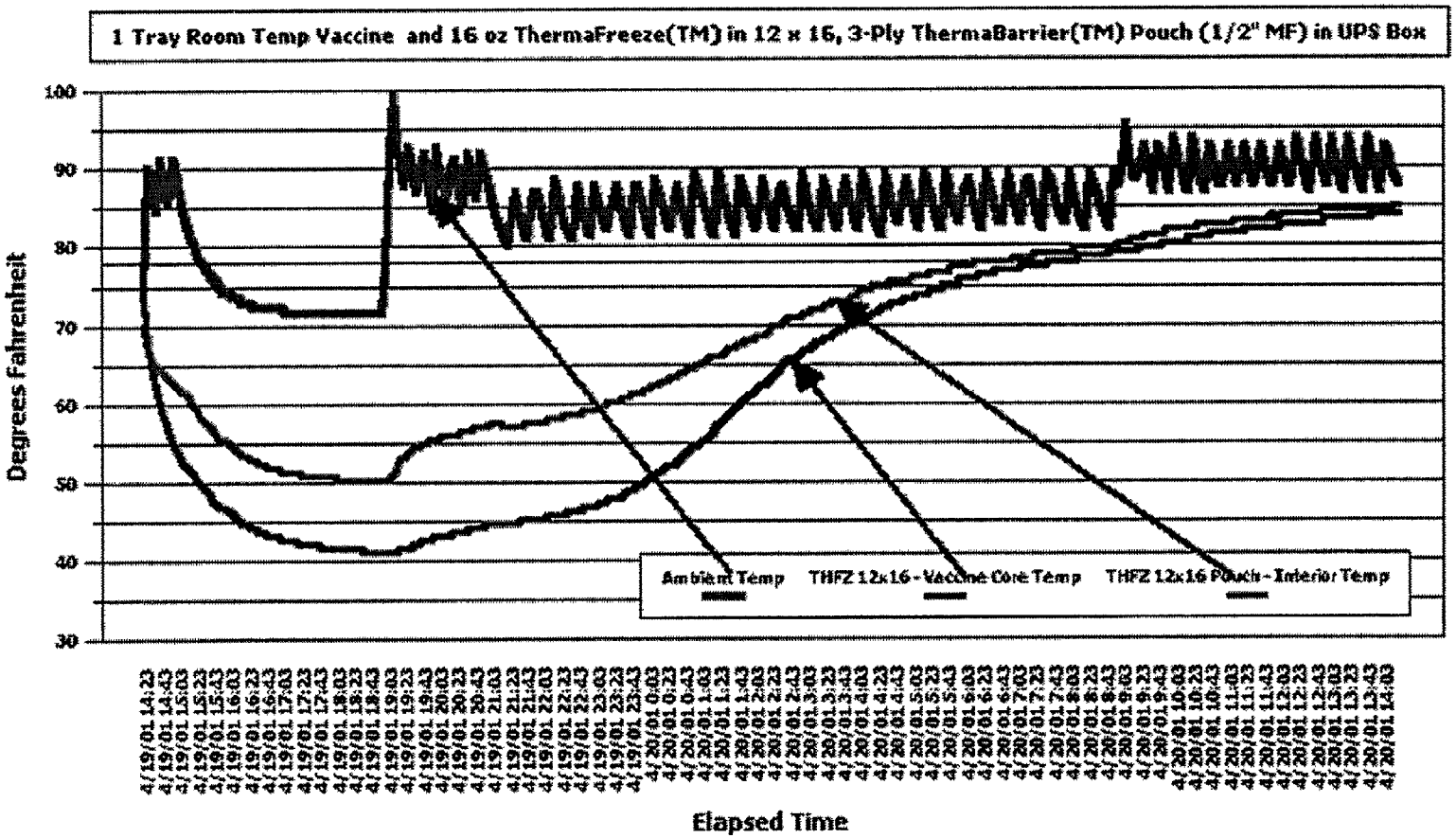

With reference to FIG. 21, the purpose of this test was to keep a tray of vaccine below seventy-eight (78°) degrees F. for fifteen to twenty (15-20 hrs.) hours, emulating a twenty-four (24 hr.) hour overnight shipment cycle. The test included a ThermaBarrier™ twelve by sixteen (12"×16") inch, 3-ply pouch using a half (½") inch thickness of Microfoam® (produced by Pactiv, Inc.) and a metallized film shell with bubble wrap laminated to the outer surface with the bubbles facing the substrate.

The refrigerant used was sixteen (16 oz.) ounces of ThermaFreeze™ and the test was conducted in a sealed laboratory chamber with a computer controlled thermostat to emulate temperature changes between daylight and nighttime hours across the test period. The ambient temperature simulation was designed to operate as close as possible to the model of the International Safe Transit Association (ISTA; East Lansing, Mich.) for summer shipments.

The 3-ply ThermaBarrier™ was used as a pouch in this case. Containing the payload, a tray of 24 vials of vaccine, and the refrigerant the pouch was placed in a standard UPS overnight shipping box for the test. The ThermaBarrier™ liner was the only heat barrier protection for the shipment and functioned as described below:

1. The outer ply of bubble wrap provides initial protection against conducted heat energy. Laminating bubble wrap to the foil (or metal) layer with the bubbles against the substrate, as is described in this art, is more difficult to manufacture than lamination with the flat side against the substrate. However, the art described in this application doubles the volume of trapped air available to act as a barrier to conducted heat since the air between the bubbles is trapped in the lamination.

If the bubble wrap is conversely laminated with the flat side to the substrate only protection against conducted heat is at each bubble containing trapped air. In that type of configuration, each bubble is surrounded by a heat leak zone around the circumference of each bubble.

2. The foil (metal) ply serves two purposes:

It acts as a protection against most of the radiant energy (i.e. UV rays from sunlight) that may get through the outer packaging since the foil (metal) ply has an emissivity rating of ninety-eight (98) and no less than ninety-four (94) with bubble wrap laminated to the outer surface.

The foil (metal) ply provides a relatively impermeable barrier to the rapid escape of cold from the refrigerant contained within the liner as a temperature control medium. In that sense the foil (metal) layer of the ThermaBarrier™ 3-ply liner acts to form a block that contains cold for a longer period of time.

3. The flexible foam ply is a dense, closed cell material (preferably polypropylene; preferably similar to Microfoam® produced by Pactiv, Incorporated) that provides an additional barrier against conducted heat energy that works its way through the first two plies. In the early stages of a two to three day shipment, the foam also tends to work with the foil (metal) ply to contain cold temperatures inside the payload zone of the package.

All of these technical properties and advantages work together to control temperature during the designated transit time in ambient temperature conditions that steadily attacked the test package with high ambient temperatures during daylight hours.

Temperature monitors were placed inside the ThermaBarrier™ liner at two locations, inside the tray of vaccine for accurate payload temperature monitoring and inside the pouch to monitor the internal pouch temperature. A third temperature monitor was placed to monitor the box top ambient temperature attacking the test package.

As is seen in FIG. 21, the core temperature of the vaccine payload did not exceed seventy-eight (78°) F. for nineteen and thirty minutes (19.5 hrs) under torture test conditions. The internal pouch temperature exceeded seventy-eight (78°) F. about ten (10) minutes before the payload. In a typical overnight delivery scenario the normal transit time is about seventeen (17) hours. That means that, with ThermaBarrier™ as the only heat barrier protection in this test, the product performed to specification with a two and a half (2.5 hr.) hour margin of safety.

It is noted that the embodiments described herein in detail in connection with FIGS. 2-9 and FIGS. 22-25 for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. An insulating, multi-ply packaging material used in connection with the packaging and shipping of goods, comprising:

a first layer of sheet material having a substantially flat surface;

a second layer of sheet material including flexible bubble wrap material having at least one side having a series of bubbles thereon, each bubble having an outermost surface, said first layer and said second layer being associated together with the outermost surfaces of said bubbles being in contacting, face-to-face, interfacing engagement with said flat surface, forming a multitudinous series of pockets of gaseous media between said bubbles and said flat surface, enhancing the temperature insulating characteristics of the packing material, said associated first and second layers of sheet material form a pouch into which the goods are placed for shipment, wherein there is further included with said pouch: flexible refrigerant material having a series of spaced packets containing super-absorbent polymeric material, which when hydrated by a liquid at a significantly different temperature than the ambient generates a significant temperature delta between the goods and the ambient, the refrigerant wrapped goods being positioned in and completely covered by said pouch;

a further sheet of bubble wrap material having bubbles surrounding the pouch with the goods located in the pouch; and a delivery box having walls having substantially flat interior wall surfaces defining an interior into which the goods are placed for shipment, the bubbles of said further sheet of bubble wrap material being directed away from said pouch and toward the interior surfaces of said box.

2. The insulating, multi-ply packaging material of claim 1, wherein:

the bubbles of said bubble wrap material are in face-to-face engagement with said interior wall surfaces, forming a further multitudinous series of pockets of gaseous media between said bubbles and said substantially flat, interior surfaces of said box, enhancing the temperature insulating characteristics of the combined bubble wrap materials and the walls of said box.

3. The insulating, multi-ply packaging material of claim 1, wherein: said associated first and second layers of sheet material form a cover, said cover being placed all about said box, covering it over and protecting it.

4. A packaging system for products, comprising:

a box having an interior made up of a set of flat surfaces;

an interior layer of bubble wrap packing material having at least one side having a series of bubbles thereon each having an outermost surface, said packing material and the interior of said box being associated together with the outermost surfaces of said bubbles being in contacting engagement with said flat surfaces, forming a series of pockets of gaseous media between said bubbles and said flat surfaces, enhancing the insulating characteristics of said packing material and said box;

a first layer of flexible sheet material having a substantially flat surface; and a second layer of flexible sheet material including flexible bubble wrap material having at least one side having a series of bubbles thereon, each bubble having an outermost surface, said first layer and said second layer being associated together with the outermost surfaces of said bubbles being in contacting, face-to-face, interfacing engagement with said substantially flat surface of said first layer forming a multitudinous series of pockets of gaseous media between said bubbles and said substantially flat surface of said first layer enhancing the temperature insulating characteristics of the packing material, said associated layers of sheet material used to be placed around the goods, with the goods and the surrounding combined, first and second layers being located in the interior of said box; and flexible refrigerant material, associated with said combined layers of flexible material, having a series of spaced packets containing super-absorbent polymeric material, which when hydrated by a liquid and when at a significantly different temperature than the ambient generates a significant temperature delta between its temperature and the ambient, the refrigerant material in association with said two, flexible layers of sheet material surrounding the goods and located in the interior of said box.

5. The packaging system of claim 4, in which there is further included: a cover placed all about said box, covering it over and protecting it.

6. The packaging system of claim 5, wherein said cover comprises: a plastic sheet with a metalized surface, with the metalized surface located facing out toward the exterior ambient surrounding the box.

* * * * *